US009316446B2

(12) United States Patent
Yoshioka et al.

(10) Patent No.: US 9,316,446 B2
(45) Date of Patent: Apr. 19, 2016

(54) HEAT EXCHANGER AND AIR CONDITIONER

(75) Inventors: Shun Yoshioka, Sakai (JP); Toshimitsu Kamada, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 272 days.

(21) Appl. No.: 13/980,650

(22) PCT Filed: Jan. 23, 2012

(86) PCT No.: PCT/JP2012/000403

§ 371 (c)(1),
(2), (4) Date: Jul. 19, 2013

(87) PCT Pub. No.: WO2012/098921

PCT Pub. Date: Jul. 26, 2012

(65) Prior Publication Data

US 2013/0299142 A1 Nov. 14, 2013

(30) Foreign Application Priority Data

Jan. 21, 2011 (JP) ..... 2011-011320

(51) Int. Cl.

| | |
|---|---|
| ***F28F 1/32*** | (2006.01) |
| ***F28D 1/053*** | (2006.01) |
| ***F28F 1/12*** | (2006.01) |
| ***F28F 19/00*** | (2006.01) |
| ***F28F 17/00*** | (2006.01) |
| ***F25B 39/00*** | (2006.01) |

(52) U.S. Cl.

CPC ..... *F28F 1/325* (2013.01); *F25B 39/00* (2013.01); *F28D 1/05383* (2013.01); *F28F 1/128* (2013.01); *F28F 17/005* (2013.01); *F28F 19/006* (2013.01); *F28F 2215/04* (2013.01)

(58) Field of Classification Search

CPC ..... F28F 1/128; F28F 1/325; F28F 2215/08; F28F 2215/12

USPC ..... 165/151, 152, 182

See application file for complete search history.

(56) References Cited

U.S. PATENT DOCUMENTS

| | | | | |
|---|---|---|---|---|
| 3,724,538 | A * | 4/1973 | Yamaguchi et al. | 165/152 |
| 4,593,756 | A * | 6/1986 | Itoh et al. | 165/151 |
| 5,042,576 | A * | 8/1991 | Broadbent | 165/151 |
| 6,273,184 | B1 | 8/2001 | Nishishita | |
| 6,431,263 | B2 * | 8/2002 | Oh et al. | 165/151 |

(Continued)

FOREIGN PATENT DOCUMENTS

| | | | |
|---|---|---|---|
| CA | 2368871 | A1 * | 8/2002 |
| EP | 1241424 | A2 | 9/2002 |
| JP | 63-34488 | A | 2/1988 |
| JP | 63-163786 | A | 7/1988 |

(Continued)

*Primary Examiner* — Allen Flanigan

(74) *Attorney, Agent, or Firm* — Birch, Stewart, Kolasch & Birch, LLP

(57) ABSTRACT

A heat exchanger includes flat tubes and fins. The fins are corrugated fins, and are disposed between the flat tubes that are vertically arranged. Between the vertically arranged flat tubes, heat transfer parts of each of the fins are arranged in the direction in which the flat tubes extend. Each of the heat transfer parts include louvers that extend in an up-and-down direction. Bent-out ends of the windward louvers include main edges, upper edges, and lower edges. The upper edges and the lower edges are tilted relative to the main edges. The tilt angle θ5 of the lower edges relative to the main edges is smaller than the tilt angle θ4 of the upper edges relative to the main edges.

4 Claims, 24 Drawing Sheets

(56) References Cited

U.S. PATENT DOCUMENTS

| | | | | |
|---|---|---|---|---|
| 6,964,296 | B2 * | 11/2005 | Memory et al. | 165/151 |
| 8,627,881 | B2 * | 1/2014 | Alahyari | 165/152 |
| 2002/0134537 | A1 * | 9/2002 | Memory et al. | 165/151 |
| 2004/0206484 | A1 * | 10/2004 | Shimoya et al. | 165/152 |
| 2008/0190588 | A1 * | 8/2008 | Heidenreich et al. | 165/151 |
| 2011/0139428 | A1 | 6/2011 | Kim et al. | |

FOREIGN PATENT DOCUMENTS

| | | | | | |
|---|---|---|---|---|---|
| JP | 5-60482 | A | | 3/1993 | |
| JP | 11-294984 | A | | 10/1999 | |
| JP | 2000234883 | A | * | 8/2000 | F28F 1/32 |
| JP | 2001-41670 | A | | 2/2001 | |
| JP | 2003-262485 | A | | 9/2003 | |
| JP | 2010-2138 | A | | 1/2010 | |

* cited by examiner

HEAT EXCHANGER AND AIR CONDITIONER

TECHNICAL FIELD

The present disclosure relates to heat exchangers including flat tubes and fins and configured to perform heat exchange between air and fluid flowing in the flat tubes.

BACKGROUND ART

Heat exchangers including flat tubes and fins have been known in the art. For example, in a heat exchanger described in Patent Document 1, laterally extending flat tubes are arranged to be spaced from one another in the vertical direction (i.e., the upward and downward directions) by a predetermined distance, and plate-like fins are arranged to be spaced from one another by a predetermined distance in the direction in which the flat tubes extend. In each of heat exchangers described in Patent Documents 2 and 3, laterally extending flat tubes are arranged to be spaced from one another in the vertical direction by a predetermined distance, and a corrugated fin is provided between each adjacent ones of the flat tubes. In these heat exchangers, air flowing while being in contact with the fins exchanges heat with fluid flowing in the flat tubes. As illustrated in FIG. 2 of Patent Document 2 and FIG. 4 of Patent Document 3, fins in heat exchangers of this type are provided with louvers for promoting heat transfer.

CITATION LIST

Patent Document

[Patent Document 1] Japanese Patent Publication No. 2003-262485

[Patent Document 2] Japanese Patent Publication No. 2010-002138

[Patent Document 3] Japanese Patent Publication No. H11-294984

SUMMARY OF THE INVENTION

Technical Problem

Refrigerant circuits of air conditioners include outdoor heat exchangers for performing heat exchange between refrigerant and outdoor air. In an outdoor heat exchanger serving as an evaporator during heating operation, moisture in the air is condensed into drain water in some cases. When the evaporating temperature of refrigerant in the outdoor heat exchanger decreases below 0° C., moisture in the air becomes frost and is attached to the outdoor heat exchanger. In heating operation under low outdoor temperatures, defrosting operation for melting frost on the outdoor heat exchanger is performed after every predetermined period, for example. Thus, drain water is also generated by the melting of frost in the defrosting operation.

On the other hand, a heat exchanger including vertically arranged flat tubes can be used as an outdoor heat exchanger of an air conditioner. However, as described above, louvers are provided in fins of the heat exchanger of this type. Accordingly, drain water might remain in narrow gaps near bent-out ends of the louvers to be insufficiently discharged from the surfaces of the fins.

It is therefore an object of the present disclosure to reduce the amount of drain water remaining on fins with louvers in a heat exchanger including the fins and flat tubes.

Solution to the Problem

A first aspect of the present disclosure is directed to a heat exchanger including: flat tubes (33) vertically arranged with side surfaces thereof facing one another, each of the flat tubes (33) including a fluid passage (34) therein; and fins (35, 36) each dividing a space between adjacent ones of the flat tubes (33) into a plurality of air passages (39) through which air flows. Each of the fins (35, 36) includes heat transfer parts (37) each having a plate shape extending from an adjacent one of the flat tubes (33) to another adjacent one of the flat tubes (33), and the heat transfer parts (37) form side walls of the air passages (39). In the fins (35, 36), louvers (50, 60) that extend in an up-and-down direction and bend out from the heat transfer parts (37) are arranged in an air passage direction. A bent-out end (53, 63) of each of the louvers (50, 60) includes a main edge (54, 64), an upper edge (55, 65) extending from an upper end of the main edge (54, 64) to an upper end of the louver (50, 60) and tilted relative to the main edge (54, 64), and a lower edge (56, 66) extending from a lower end of the main edge (54, 64) to a lower end of the louver (50, 60) and tilted relative to the main edge (54, 64). In at least one of the louvers (50, 60) provided on each of the heat transfer parts (37), a tilt angle of the lower edge (56, 66) relative to the main edge (54, 64) is smaller than a tilt angle of the upper edge (55, 65) relative to the main edge (54, 64).

In the first aspect, the heat exchanger (30) includes the flat tubes (33) and the fins (35, 36). The heat transfer parts (37) of the fins (35, 36) are located between the vertically arranged flat tubes (33). In the heat exchanger (30), air passes through the air passages (39) between the vertically arranged flat tubes (33), and exchanges heat with fluid flowing through the fluid passages (34) in the flat tubes (33). In each of the heat transfer parts (37) of the fins (35, 36), the louvers (50, 60) extending in an up-and-down direction are arranged in the air passage direction.

In the first aspect, the bent-out end (53, 63) of each of the louvers (50, 60) includes the main edge (54, 64), the upper edge (55, 65), and the lower edge (56, 66). In at least one of the louvers (50, 60) provided on each of the heat transfer parts (37) of the fins (35, 36), the tilt angle of the lower edge (56, 66) relative to the main edge (54, 64) is smaller than the tilt angle of the upper edge (55, 65) relative to the main edge (54, 64). Thus, between the bent-out ends (53, 63*a*) of the louvers (50, 60*a*) that are adjacent to each other in the air passage direction, a gap between the lower edges (56, 66) is more slender than that between the upper edges (55, 65).

On the surfaces of the fins (35, 36) of the heat exchanger (30), moisture in the air is condensed and frost attached to the fins (35, 36) melts, thereby generating drain water. The drain water generated on the surfaces of the fins (35, 36) also enters a gap between the bent-out ends (53, 63*a*) of the louvers (50, 60*a*) that are adjacent to each other in the air passage direction. The drain water that has entered the gaps between the louvers (50, 60*a*) is drawn into gaps between the slender lower edges (56, 66) by a capillary phenomenon.

In a second aspect of the present disclosure, in the heat exchanger (30) of the first aspect, at least one of the louvers (50, 60) provided on each of the heat transfer parts (37) of the fins (35, 36) is a symmetric louver (60*b*) which is located in a leeward region of the louvers (50, 60) and in which a tilt angle of the lower edge (66) relative to the main edge (64) is equal to a tilt angle of the upper edge (65) relative to the man edge (64), and each of the other louvers (50, 60) located at a windward side of the symmetric louver (60*b*) is an asymmetric louver (50, 60*a*) in which a tilt angle of the lower edge (56, 66) relative to the main edge (54, 64) is smaller than a tilt angle of the upper edge (55, 65) to the main edge (54, 64).

In the second aspect, both the asymmetric louver (50, 60*a*) and the symmetric louver (60*b*) are provided on each of the heat transfer parts (37) of the fins (35, 36). In the asymmetric louver (50, 60*a*), the tilt angle of the lower edge (56, 66) relative to the main edge (54, 64) is smaller than the tilt angle of the upper edge (55, 65) relative to the main edge (54, 64). On the other hand, in the symmetric louver (60*b*), the tilt angle of the lower edge (66) relative to the main edge (64) is equal to the tilt angle of the upper edge (65) relative to the main edge (64). In each of the heat transfer parts (37), the asymmetric louver (50, 60*a*) is located at the windward side of the symmetric louver (60*b*).

In a third aspect of the present disclosure, in the heat exchanger (30) of the first or second aspect, the fins (36) each have a plate shape with notches (45) into which the flat tubes (33) are inserted, are arranged to be spaced from one another by a predetermined distance in a direction in which the flat tubes (33) extend, and sandwich the flat tubes (33) at edges of the notches (45), and parts of the fins (36) between vertically adjacent ones of the notches (45) are the heat transfer parts (37).

In the third aspect, the plate-like fins (36) are arranged to be spaced from one another by a predetermined distance in a direction in which the flat tubes (33) extend. Each of the fins (36) has notches (45) into which the flat tubes (33) are inserted. In the fins (36), the peripheries of the notches (45) sandwich the flat tubes (33). Spaces between vertically adjacent ones of the notches (45) of the fins (36) are the heat transfer parts (37).

In a fourth aspect of the present disclosure, in the heat exchanger (30) of the first or second aspect, each of the fins (35) is a corrugated fin that bends up and down and is located between adjacent ones of the flat tubes (33), includes the heat transfer parts (37) arranged in a direction in which the flat tubes (33) extend, and also includes intermediate plate parts (41) continuous to upper or lower ends of adjacent ones of the heat transfer parts (37) and joined to the flat tubes (33).

In the fourth aspect, the fins (35) that are corrugated fins are located between adjacent ones of the flat tubes (33). Each of the fins (35) includes the heat transfer parts (37) arranged in the direction in which the flat tubes (33) extend. In the fins (35), adjacent ones of the heat transfer parts (37) are continuous to an associated one of the intermediate plate parts (41), and the intermediate plate parts (41) are joined to flat side surfaces of the flat tubes (33).

A fifth aspect of the present disclosure is directed to an air conditioner (10) including a refrigerant circuit (20) including the heat exchanger (30) of any one of the first through fourth aspects, and the refrigerant circuit (20) circulates refrigerant therein, thereby performing a refrigeration cycle.

In the fifth aspect, the heat exchanger (30) of any one of the first through fourth aspects is connected to the refrigerant circuit (20). In the heat exchanger (30), refrigerant circulating in the refrigerant circuit (20) flows through the fluid passages (34) of the flat tubes (33), and exchanges heat with air flowing in the air passages (39).

Advantages of the Invention

According to the present disclosure, the multiple louvers (50, 60) are provided on each of the heat transfer parts (37) of the fins (35, 36), and in at least one of the louvers (50, 60), the tilt angle of the lower edge (56, 66) relative to the main edge (54, 64) is smaller than the tilt angle of the upper edge (55, 65) relative to the main edge (54, 64). Thus, drain water generated on the surfaces of the fins (35, 36) and present between the bent-out ends (53, 63*a*) of the louvers (50, 60*a*) that are adjacent to each other in the air passage direction can be drawn into gaps between slender lower edges (56, 66) by a capillarity phenomenon. Thus, the technique of the present disclosure can allow drain water between the bent-out ends (53, 63*a*) of the louvers (50, 60*a*) that are adjacent to each other in the air passage direction to flow downward by not only gravity but also a capillary phenomenon, thereby reducing the amount of drain water remaining on the surfaces of the heat transfer parts (37).

In particular, in the second aspect, the asymmetric louver (50, 60*a*) is provided at a windward region of each of the heat transfer parts (37) of the fins (35, 36). That is, in the heat transfer part (37) of the second aspect, the asymmetric louver (50, 60*a*) is provided in a windward region where a relatively large amount of drain water is generated, and the symmetric louver (60*b*) is provided in a leeward region where a relatively small amount of drain water is generated. Accordingly, the heat exchanger of the second aspect ensures reduction of the drain water remaining on the windward region of the heat transfer part (37) where a relatively large amount of drain water is generated.

BRIEF DESCRIPTION OF THE DRAWINGS

FIG. 6A is a front view of the heat transfer part, and FIG. 6B is a cross-sectional view taken along the line B-B in FIG. 6A.

FIG. 7A is a cross-sectional view illustrating windward louvers, and FIG. 7B is a cross-sectional view illustrating leeward louvers.

FIG. 8A is a view taken along the line C-C in FIGS. 6A and 6B, and FIG. 8B is a view taken along the line D-D in FIGS. 6A and 6B.

FIG. 15A is a front view of the fin, and FIG. 15B is a cross-sectional view taken along the line G-G in FIG. 15A.

FIG. 16A is a cross-sectional view illustrating windward louvers, and FIG. 16B is a cross-sectional view illustrating leeward louvers.

FIG. 17A is a view taken along the line H-H in FIGS. 15A and 15B, and FIG. 17B is a view taken along the line I-I in FIGS. 15A and 15B.

FIG. 20A is a front view of the fin, and FIG. 20B is a cross-sectional view taken along the line H-H in FIG. 15A.

FIG. 22A is a front view of the heat transfer parts, and FIG. 22B is a cross-sectional view taken along the line J-J in FIG. 22A.

FIG. 23A is a front view of the heat transfer parts, and FIG. 23B is a cross-sectional view taken along the line K-K in FIG. 23A.

DESCRIPTION OF EMBODIMENTS

Embodiments of the present disclosure will be described with reference to the drawings.

First Embodiment

A first embodiment of the present disclosure will now be described. A heat exchanger (30) according to the first embodiment constitutes an outdoor heat exchanger (23) of an air conditioner (10), which will be described later.

—Air Conditioner—

Figure 1:
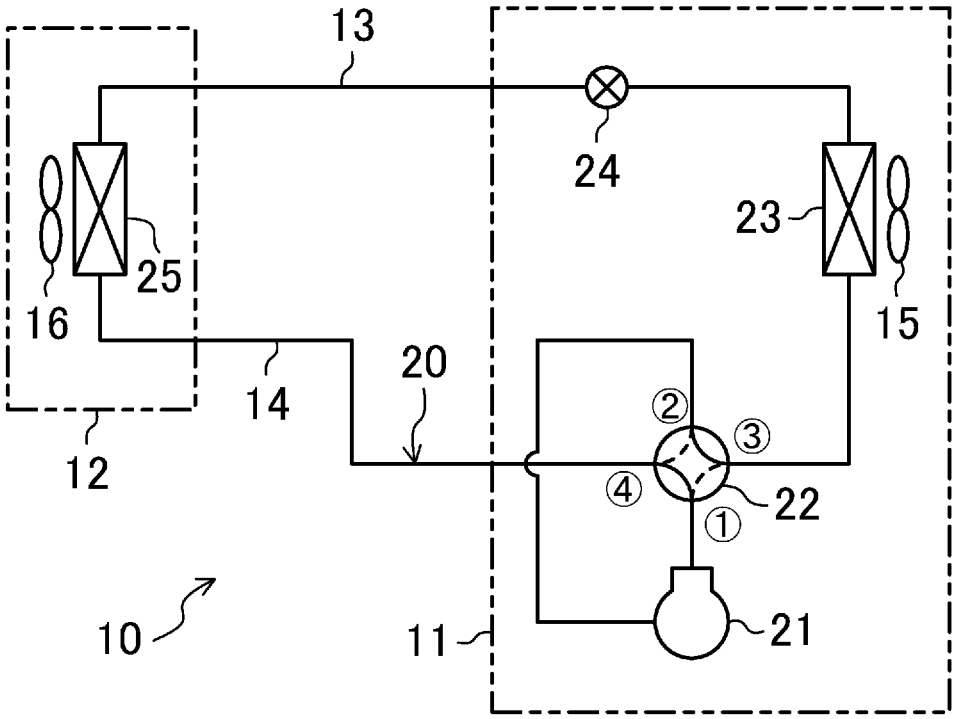
FIG. 1 is a refrigerant circuit diagram schematically illustrating an air conditioner including a heat exchanger according to a first embodiment.

Referring now to FIG. 1, the air conditioner (10) including the heat exchanger (30) of this embodiment will be described.

<Configuration of Air Conditioner>

The air conditioner (10) includes an outdoor unit (11) and an indoor unit (12). The outdoor unit (11) and the indoor unit (12) are connected to each other through a liquid communication pipe (13) and a gas communication pipe (14). In the air conditioner (10), the outdoor unit (11), the indoor unit (12), the liquid communication pipe (13), and the gas communication pipe (14) constitute a refrigerant circuit (20).

The refrigerant circuit (20) includes a compressor (21), a four-way valve (22), an outdoor heat exchanger (23), an expansion valve (24), and an indoor heat exchanger (25). The compressor (21), the four-way valve (22), the outdoor heat exchanger (23), and the expansion valve (24) are housed in the outdoor unit (11). The outdoor unit (11) includes outdoor fans (15) for supplying outdoor air to the outdoor heat exchanger (23). On the other hand, the indoor heat exchanger (25) is housed in the indoor unit (12). The indoor unit (12) includes indoor fans (16) for supplying indoor air to the indoor heat exchanger (25).

The refrigerant circuit (20) is a closed circuit charged with refrigerant. In the refrigerant circuit (20), a discharge side of the compressor (21) is connected to a first port of the four-way valve (22) and a suction side of the compressor (21) is connected to a second port of the four-way valve (22). In the refrigerant circuit (20), the outdoor heat exchanger (23), the expansion valve (24), and the indoor heat exchanger (25) are arranged in this order from a third port to a fourth port of the four-way valve (22).

The compressor (21) is a scroll or rotary hermetic compressor. The four-way valve (22) switches between a first position (indicated by broken lines in FIG. 1) at which the first port communicates with the third port and the second port communicates with the fourth port and a second position (indicated by continuous lines in FIG. 1) at which the first port communicates with the fourth port and the second port communicates with the third port. The expansion valve (24) is a so-called electronic expansion valve.

The outdoor heat exchanger (23) performs heat exchange between outdoor air and refrigerant. The outdoor heat exchanger (23) is constituted by the heat exchanger (30) of this embodiment. On the other hand, the indoor heat exchanger (25) performs heat exchange between indoor air and refrigerant. The indoor heat exchanger (25) is a so-called cross-fin type fin-and-tube heat exchanger including a circular heat transfer tube.

<Cooling Operation>

The air conditioner (10) performs cooling operation. In the cooling operation, the four-way valve (22) is set at the first position. In addition, in the cooling operation, the outdoor fans (15) and the indoor fans (16) operate.

The refrigerant circuit (20) performs a refrigeration cycle. Specifically, refrigerant discharged from the compressor (21) flows into the outdoor heat exchanger (23) through the four-way valve (22), and dissipates heat into the outdoor air to be condensed. Refrigerant that has flown out of the outdoor heat exchanger (23) expands when passing through the expansion valve (24), then flows into the indoor heat exchanger (25), and absorbs heat from the indoor air to evaporate. Refrigerant that has flown out of the indoor heat exchanger (25) passes through the four-way valve (22) and then is sucked into the compressor (21) to be compressed therein. The indoor unit (12) supplies air cooled in the indoor heat exchanger (25) into the room.

<Heating Operation>

The air conditioner (10) performs heating operation. In the heating operation, the four-way valve (22) is set at the second position. In addition, in the heating operation, the outdoor fans (15) and the indoor fans (16) operate.

The refrigerant circuit (20) performs a refrigeration cycle. Specifically, refrigerant discharged from the compressor (21) flows into the indoor heat exchanger (25) through the four-way valve (22), and dissipates heat into the indoor air to be condensed. Refrigerant that has flown out of the indoor heat exchanger (25) expands when passing through the expansion valve (24), then flows into the outdoor heat exchanger (23), and absorbs heat from the outdoor air to evaporate. Refrigerant that has flown out of the outdoor heat exchanger (23) passes through the four-way valve (22) and then is sucked into the compressor (21) to be compressed therein. The indoor unit (12) supplies air heated in the indoor heat exchanger (25) into the room.

<Defrost Operation>

As described above, in the heating operation, the outdoor heat exchanger (23) serves as an evaporator. Under operating conditions where the temperature of the outdoor air is low, the evaporating temperature of refrigerant in the outdoor heat exchanger (23) is lower than 0° C. in some cases. In these cases, moisture in the outdoor air becomes frost and is attached to the outdoor heat exchanger (23). To prevent this, the air conditioner (10) performs defrosting operation every when the time duration of the heating operation reaches a predetermined value (e.g., several ten minutes), for example.

To start defrosting operation, the four-way valve (22) switches from the second position to the first position, and the outdoor fans (15) and the indoor fans (16) stop. In the refrigerant circuit (20) during the defrosting operation, high-temperature refrigerant discharged from the compressor (21) is supplied to the outdoor heat exchanger (23). In the outdoor heat exchanger (23), frost attached to the surface of the outdoor heat exchanger (23) is heated by the refrigerant, and melts. The refrigerant that has dissipated heat in the outdoor heat exchanger (23) passes through the expansion valve (24) and the indoor heat exchanger (25) in this order, and then is sucked into the compressor (21) to be compressed. After the defrosting operation is finished, heating operation is started again. That is, the four-way valve (22) switches from the first position to the second position, and the outdoor fans (15) and the indoor fans (16) operate again.

—Heat Exchanger of First Embodiment—

The heat exchanger (30) of this embodiment constituting the outdoor heat exchanger (23) of the air conditioner (10) will be described with reference to FIGS. 2-9 as necessary.

<Overall Configuration of Heat Exchanger>

Figure 2:
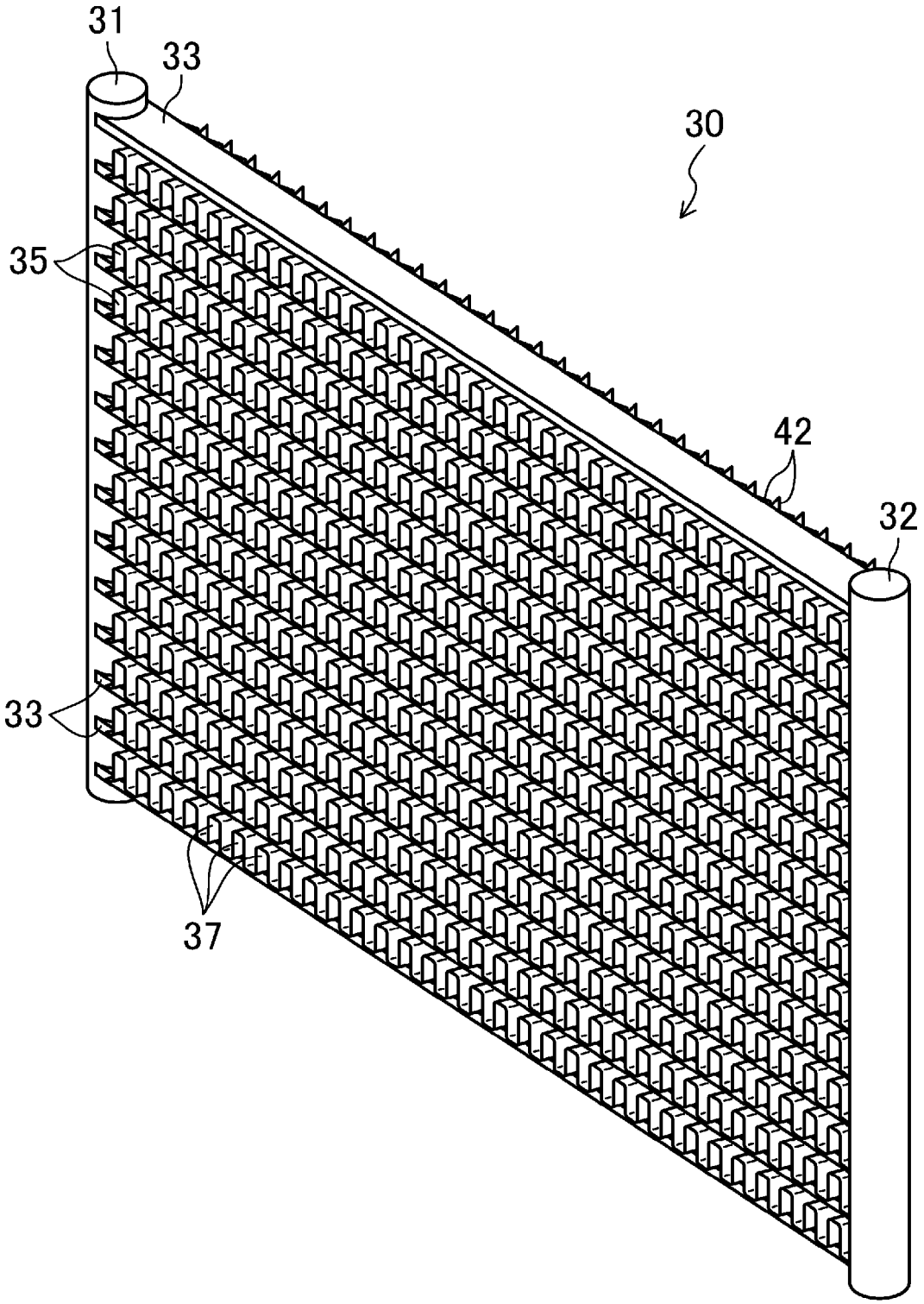
FIG. 2 is a perspective view schematically illustrating the heat exchanger of the first embodiment.
Figure 3:
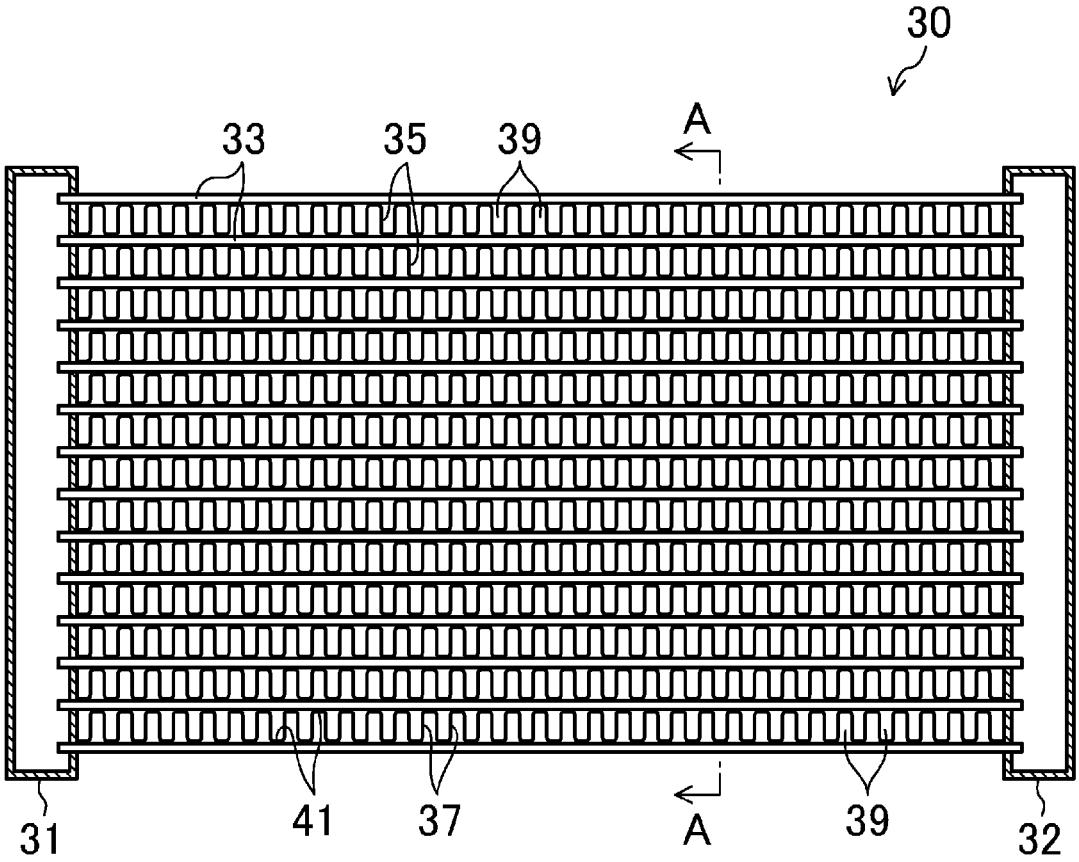
FIG. 3 is a partial cross-sectional view illustrating the heat exchanger of the first embodiment when viewed from the front.

As illustrated in FIGS. 2 and 3, the heat exchanger (30) of this embodiment includes a first header concentrated pipe (31), a second header concentrated pipe (32), a large number of flat tubes (33), and a large number of fins (35). The first header concentrated pipe (31), the second header concentrated pipe (32), the flat tubes (33), and the fins (35) are made of an aluminium alloy, and are joined to one another by brazing.

Each of the first header concentrated pipe (31) and the second header concentrated pipe (32) has a slender hollow cylindrical shape whose both ends are closed. As illustrated in FIG. 3, the first header concentrated pipe (31) stands at the left end of the heat exchanger (30), and the second header concentrated pipe (32) stands at the right end of the heat exchanger (30). That is, the first and second header concentrated pipes (31) and (32) are oriented such that the axes thereof extend in the vertical direction.

Figure 4:
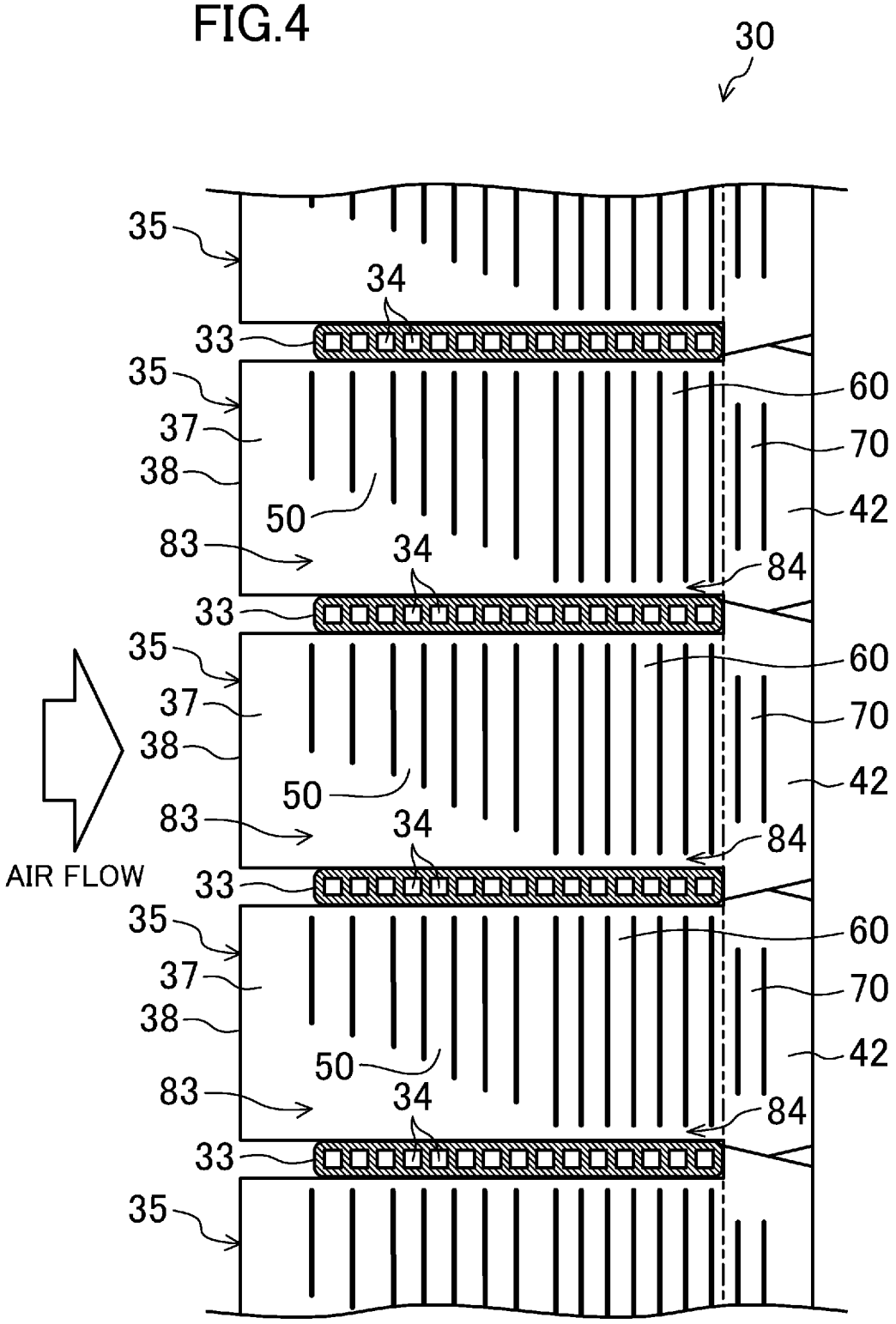
FIG. 4 is a cross-sectional view partially illustrating the heat exchanger taken along the line A-A in FIG. 3.

As also illustrated in FIG. 4, each of the flat tubes (33) is a heat transfer tube that is in the shape of a flat ellipse or a rounded rectangle in cross section. In the heat exchanger (30), the direction in which the flat tubes (33) extend is the transverse direction, and the flat side surfaces of the flat tubes (33) face one another. The flat tubes (33) are spaced from one another in the vertical direction by a predetermined distance. Each of the flat tubes (33) has its one end inserted in the first header concentrated pipe (31) and the other end inserted in the second header concentrated pipe (32).

As illustrated in FIG. 4, each of the flat tubes (33) has a plurality of fluid passages (34). The fluid passages (34) extend in the direction in which the flat tubes (33) extend. In each of the flat tubes (33), the fluid passages (34) are arranged side by side in the width direction orthogonal to the direction in which the flat tubes (33) extend. The fluid passages (34) of each of the flat tubes (33) has its one end communicate with the inner space of the first header concentrated pipe (31) and the other end communicate with the inner space of the second header concentrated pipe (32). Refrigerant supplied to the heat exchanger (30) exchanges heat with the air while flowing in the fluid passages (34) of the flat tubes (33).

Each of the fins (35) is a corrugated fin that bends up and down, and is located between vertically adjacent ones of the flat tubes (33). Each of the fins (35) includes a plurality of heat transfer parts (37) and a plurality of intermediate plate parts (41), which will be described in detail later. In each of the fins (35), the intermediate plate parts (41) are brazed to adjacent ones of the flat tubes (33).

As illustrated in FIG. 3, in the heat exchanger (30), a space between vertically adjacent ones of the flat tubes (33) is divided into a plurality of air passages (39) by the heat transfer parts (37) of the fin (35). The heat exchanger (30) performs heat exchange between refrigerant flowing in the fluid passages (34) of the flat tubes (33) and air flowing in the air passages (39).

As described above, the heat exchanger (30) includes: the vertically arranged flat tubes (33) whose flat side surfaces face one another; and the fins (35) each including the plate-like heat transfer parts (37) extending from one of its adjacent flat tubes (33) to the other. The heat transfer parts (37) are located between adjacent ones of the flat tubes (33), and arranged side by side in the direction in which the flat tubes (33) extend. In the heat exchanger (30), air flowing between adjacent ones of the heat transfer parts (37) exchanges heat with fluid flowing in the flat tubes (33).

<Fin Configuration>

Figure 5:
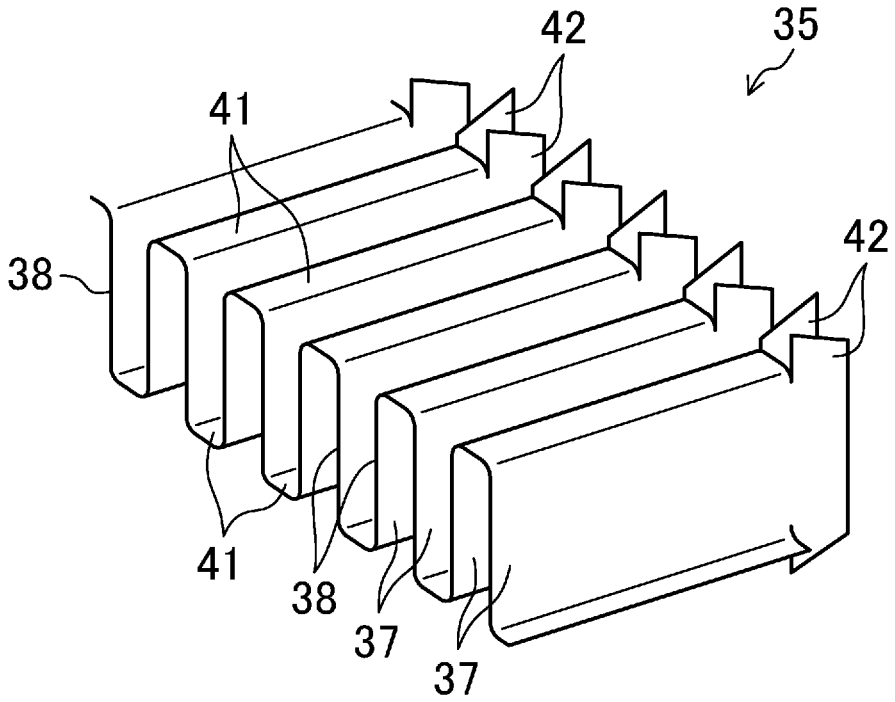
FIG. 5 is a perspective view schematically illustrating a fin provided in the heat exchanger of the first embodiment.

As illustrated in FIG. 5, each of the fins (35) is a corrugated fin formed by bending a metal plate with a uniform width, and bends up and down. In the fin (35), the heat transfer parts (37) and the intermediate plate parts (41) are alternately arranged in the direction in which the flat tubes (33) extend. That is, the fin (35) includes the heat transfer parts (37) that are located between adjacent ones of the flat tubes (33) and arranged side by side in the direction in which the flat tubes (33) extend. The fin (35) also includes projecting plate parts (42). In FIG. 5, louvers (50, 60, 70) and a water-conveyance ribs (71) are not shown.

The heat transfer parts (37) are plate-like parts each extending from one of its vertically adjacent ones of the flat tubes (33) to the other. The windward ends of the heat transfer parts (37) hereinafter referred to as front edges (38). Although not shown in FIG. 5, the heat transfer parts (37) include a plurality of louvers (50, 60). The intermediate plate parts (41) are plate-like parts along the flat side surfaces of the flat tubes (33), The intermediate plate parts (41) of laterally (i.e., in the transverse direction) adjacent ones of the heat transfer parts (37) are continuous at the upper and lower ends thereof. The heat transfer parts (37) are approximately at a right angle relative to the intermediate plate parts (41).

The projecting plate parts (42) are plate-like parts that are continuous to leeward eof the heat transfer parts (37). The projecting plate parts (42) are each in the shape of a vertically extending slender plate, and project leeward from the flat tubes (33). The projecting plate parts (42) have their upper ends project upward from the upper ends of the heat transfer parts (37) and their lower ends project downward from the lower ends of the heat transfer parts (37). As illustrated in FIG. 4, in the heat exchanger (30), the projecting plate parts (42) of vertically adjacent ones of the fins (35) sandwiching an associated one of the flat tubes (33) are in contact with each other.

Figure 6A:
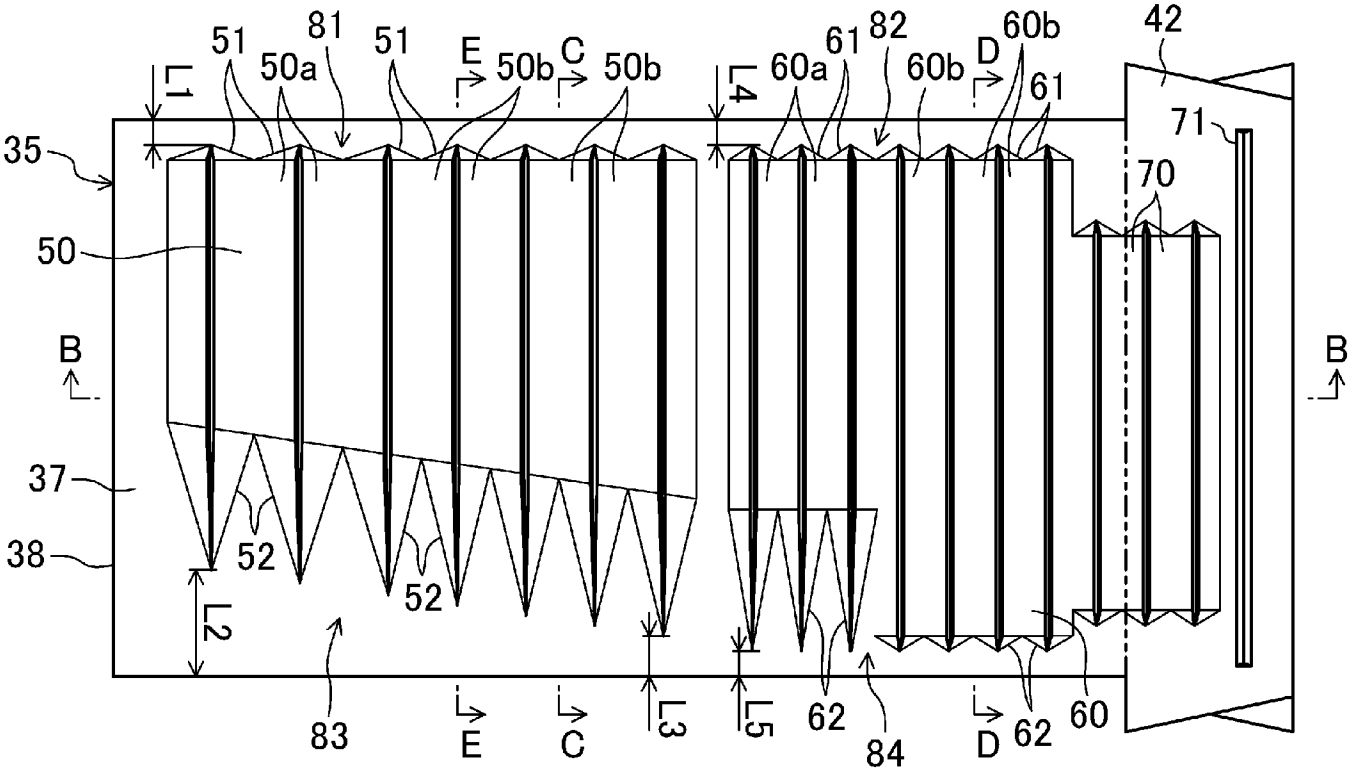
FIGS. 6A and 6B are views illustrating a heat transfer part provided in the fin of the heat exchanger of the first embodiment.
Figure 6B:
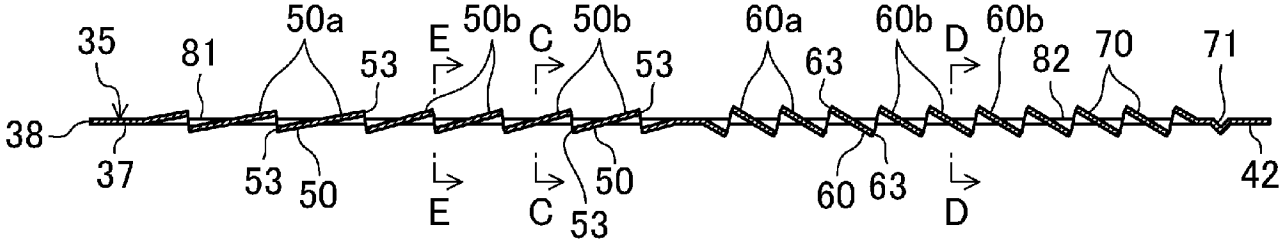

As illustrated in FIGS. 6A and 6B, a plurality of louvers (50, 60, 70) are provided in the heat transfer part (37) and the projecting plate part (42) of the fin (35). The louvers (50, 60, 70) bend out from the heat transfer part (37) and the projecting plate part (42). That is, the louvers (50, 60, 70) are obtained by forming slits in the heat transfer part (37) and the projecting plate part (42) and plastically deforming portions between adjacent ones of the slits.

The longitudinal direction of the louvers (50, 60, 70) is substantially in parallel with the front edge (38) of the heat transfer part (37) (i.e., substantially in the vertical direction). That is, the longitudinal direction of the louver (50, 60, 70) coincides with the vertical direction. In the heat transfer parts (37), the louvers (50, 60, 70) extending in the vertical direction are arranged side by side from the windward to the leeward.

In the heat transfer part (37), six louvers located in a windward region are windward louvers (50). That is, in the heat transfer part (37), six adjacent louvers including the louver closest to the windward side are the windward louvers (50). In addition, six louvers located in a region adjacent to the leeward side of the region including the windward louvers (50) are leeward louvers (60). Further, two louvers located in a region extending from the leeward side of the heat transfer part (37) to the projecting plate part (42) are auxiliary louvers (70).

In this manner, the six windward louvers (50), the six leeward louvers (60), and the two auxiliary louvers (70) are arranged in this order from the windward side to the leeward side in the heat transfer part (37). The numbers of the louvers (50, 60, 70) described above are merely examples. The shapes of the louvers (50, 60, 70) will be described in detail later.

Portions of the heat transfer part (37) of the fin (35) except the louvers (50, 60, 70) are flat without bending and unevenness.

Specifically, in the heat transfer part (37), flat regions between the upper end of the heat transfer part (37) and the windward louvers (50) are first upper flat parts (81), and flat regions between the upper end of the heat transfer part (37) and the leeward louvers (60) are second upper flat parts (82). The first upper flat parts (81) are continuous to the windward louvers (50), and adjacent to crests (51) at the upper ends of the windward louvers (50). The second upper flat parts (82) are continuous to the leeward louvers (60), and adjacent to crests (61) at the upper ends of the leeward louvers (60).

In the heat transfer part (37), flat regions between the lower end of the heat transfer part (37) and the windward louvers (50) are first lower flat parts (83), and flat regions between the lower end of the heat transfer part (37) and the leeward louvers (60) are second lower flat parts (84). The first lower flat parts (83) are continuous to the windward louvers (50), and adjacent to crests (52) located at the lower ends of the windward louvers (50). The second lower flat parts (84) are continuous to the leeward louvers (60), and adjacent to crests (62) at the lower ends of the leeward louvers (60).

The projecting plate part (42) of the fin (35) includes a water-conveyance rib (71). The water-conveyance rib (71) is a slender groove extending in the vertical direction along the leeward side of the projecting plate part (42).

<Louver Shape>

The shapes of the louvers (50, 60, 70) formed in the fins (35) are described in detail. The "right" and "left" herein are based on the direction when the fins (35) are seen from the windward side (i.e., from the front side of the heat exchanger (30)).

As illustrated in FIG. 6A, the vertical lengths of the windward louvers (50) gradually increase from the windward side to the leeward side thereof. Specifically, in the heat transfer parts (37), the windward louver (50) closest to the windward side is the shortest, and the windward louver (50) closest to the leeward side is the longest. The upper ends of the windward louvers (50) are located at the same distance (have the same length L1) from the upper end of the heat transfer part (37). Thus, the vertical positions of the lower ends of the windward louvers (50) gradually become lower from the windward side to the leeward side. Specifically, the length L2 from the lower end of the windward louver (50) closest to the windward side to the lower end of the heat transfer part (37) is larger than the length L3 from the lower end of the windward louver (50) closest to the leeward side to the lower end of the heat transfer part (37) (i.e., L2>L3). The length L1 from the upper ends of the windward louvers (50) to the upper end of the heat transfer part (37) is smaller than the length L3 from the lower end of the windward louver (50) closest to the leeward side to the lower end of the heat transfer part (37) (i.e., L3>L1).

The leeward louvers (60) have the same vertical length. The leeward louvers (60) are longer than the windward louver (50) closest to the leeward side. The length L4 from the upper ends of the leeward louvers (60) to the upper end of the heat transfer part (37) is uniform. The length L4 is equal to the length L1 from the upper ends of the windward louvers (50) to the upper end of the heat transfer part (37). Thus, the length L5 from the lower ends of the leeward louvers (60) to the lower end of the heat transfer part (37) is smaller than the length L3 from the lower end of the windward louver (50) closest to the leeward side to the lower end of the heat transfer part (37) (i.e., L3>L5).

The vertical length of the auxiliary louvers (70) is smaller than the vertical length of the leeward louvers (60). The upper ends of the auxiliary louvers (70) are located below the upper ends of the leeward louvers (60). The lower ends of the auxiliary louvers (70) are located below the lower ends of the leeward louvers (60).

The windward louvers (50) and the leeward louvers (60) having the above-described lengths are formed in the heat transfer part (37). As described above, in the heat transfer part (37), the first lower flat parts (83) are formed below the windward louvers (50), and the second lower flat parts (84) are formed below the leeward louvers (60). Thus, in the heat transfer part (37), the width, in the vertical direction, of the first lower flat parts (83) is larger than that of the second lower flat parts (84).

Figure 8B:
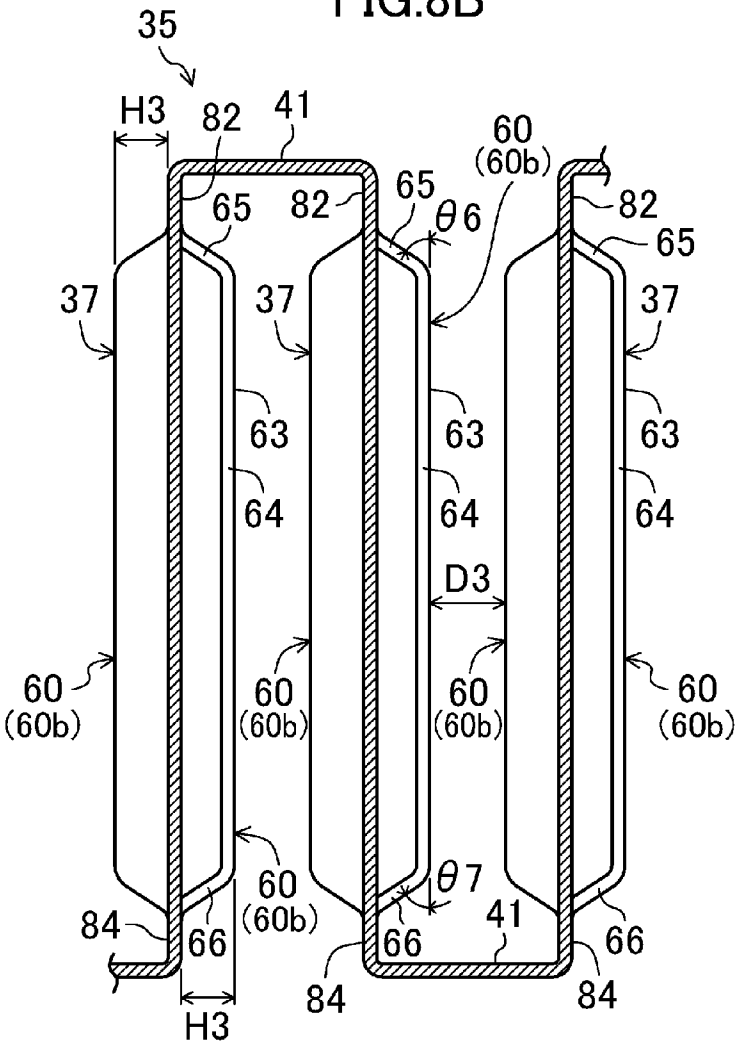
FIGS. 8A and 8B are cross-sectional views illustrating the fin provided in the heat exchanger of the first embodiment.
Figure 8A:
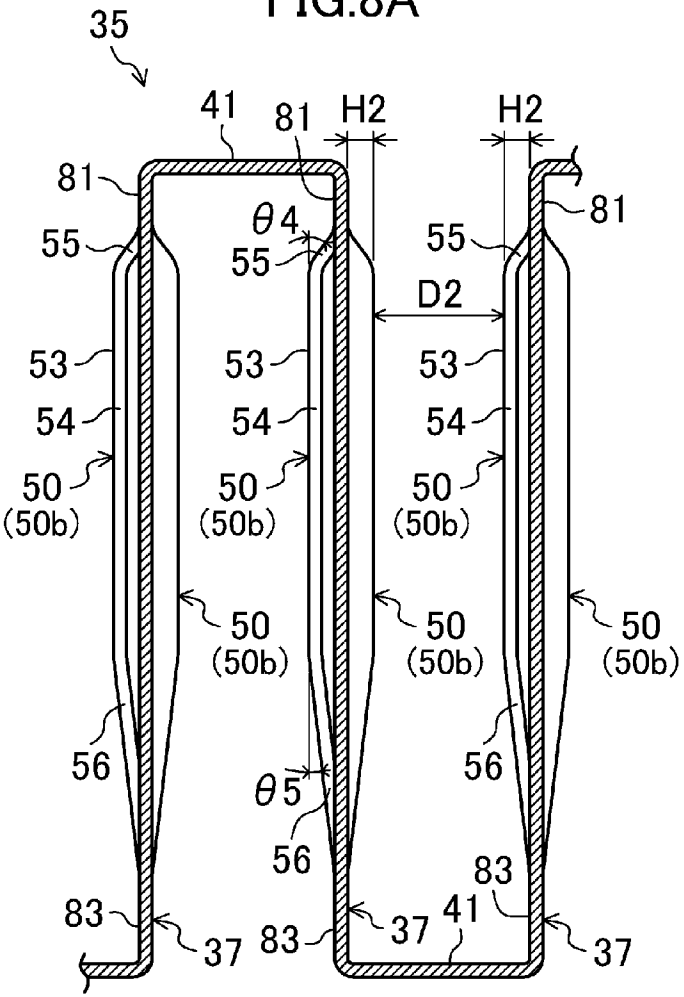

As illustrated in FIG. 6B, the louvers (50, 60, 70) are tilted relative to the flat portions (81-84). The windward louvers (50) and the leeward louvers (60) are tilted in opposite directions, and the leeward louvers (60) and the auxiliary louvers (70) are tilted in the same direction. As also illustrated in FIGS. 8A and 8B, in the windward louvers (50), windward bent-out ends (53) protrude to the left, and leeward bent-out ends (53) protrude to the right. In the leeward louvers (60), windward bent-out ends (63) protrude to the right, and leeward bent-out ends (63) protrude to the left.

Figure 7A:
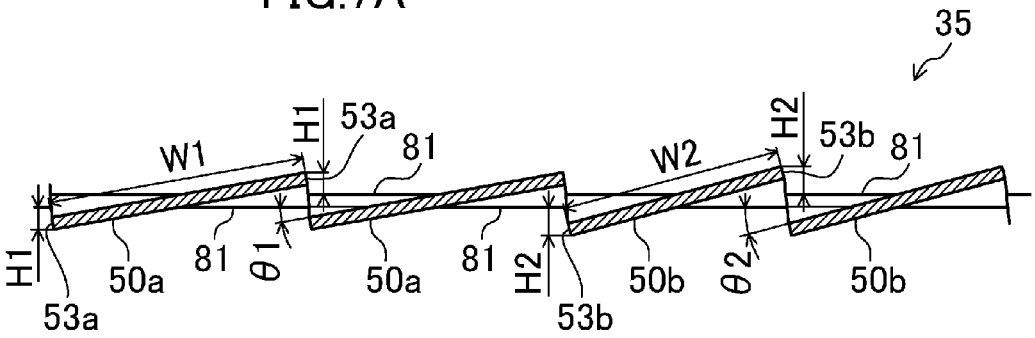
FIGS. 7A and 7B are enlarged views partially illustrating part of the heat transfer part illustrated in FIG. 6B.
Figure 7B:
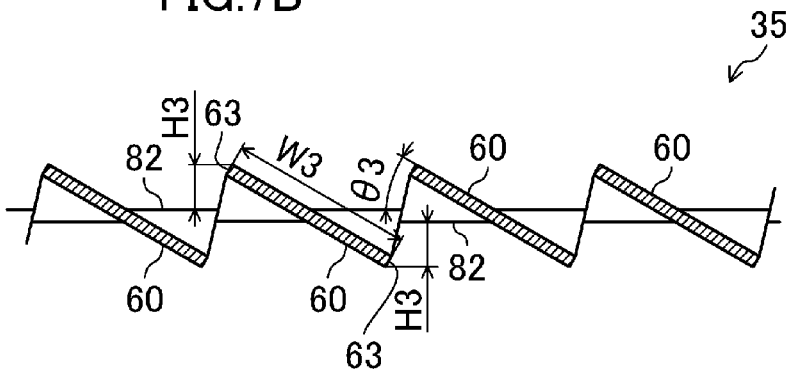

As illustrated in FIG. 7A, two windward louvers (50*a*) located at the windward side have a width W1 in the transverse direction (i.e., in the air passage direction), a tilt angle θ1 relative to the flat portions (81, 83), and a bent-out height (i.e., the distance from the bent-out ends (53*a*) to the flat portions (81, 83)) H1. Four windward louvers (50*b*) located at the leeward side have a width W2 in the transverse direction (in the air passage direction), a tilt angle θ2 relative to the flat portions (81, 83), and a bent-out height (i.e., the distance from the bent-out ends (53*b*) to the flat portions (81, 83)) H2. As illustrated in FIG. 7B, the leeward louvers (60) has a width W3 in the transverse direction (in the air passage direction), a tilt angle θ3 relative to the flat portions (82, 84), and a bent-out height (i.e., the distance from the bent-out ends (63) to the flat portions (82, 84)) H3. The width, the tilt angle relative to the flat portions (82, 84), and the bent-out height of the auxiliary louvers (70) are equal to those of the leeward louvers (60).

As illustrated in FIGS. 7A and 7B, the width W1 of the windward louvers (50*a*) is larger than the width W2 of the windward louvers (50*b*), and the width W2 of the windward louvers (50*b*) is larger than the width W3 of the leeward louvers (60) (i.e., W1>W2>W3). The tilt angle θ1 of the windward louvers (50*a*) is smaller than the tilt angle θ2 of the windward louvers (50*b*), and the tilt angle θ2 of the windward louvers (50*b*) is smaller than the tilt angle θ3 of the leeward louvers (60) (i.e., θ1<θ2<θ3). That is, the windward louvers (50*a*) are tilted more gently than the windward louvers (50*b*), and the windward louvers (50*b*) are tilted more gently than the leeward louvers (60). The bent-out height H1 of the windward louvers (50*a*) is smaller than the bent-out height H2 of the windward louvers (50*b*), and the bent-out height H2 of the windward louvers (50*b*) is smaller than the bent-out height H3 of the leeward louvers (60) (i.e., H1<H2<H3).

Figure 9:
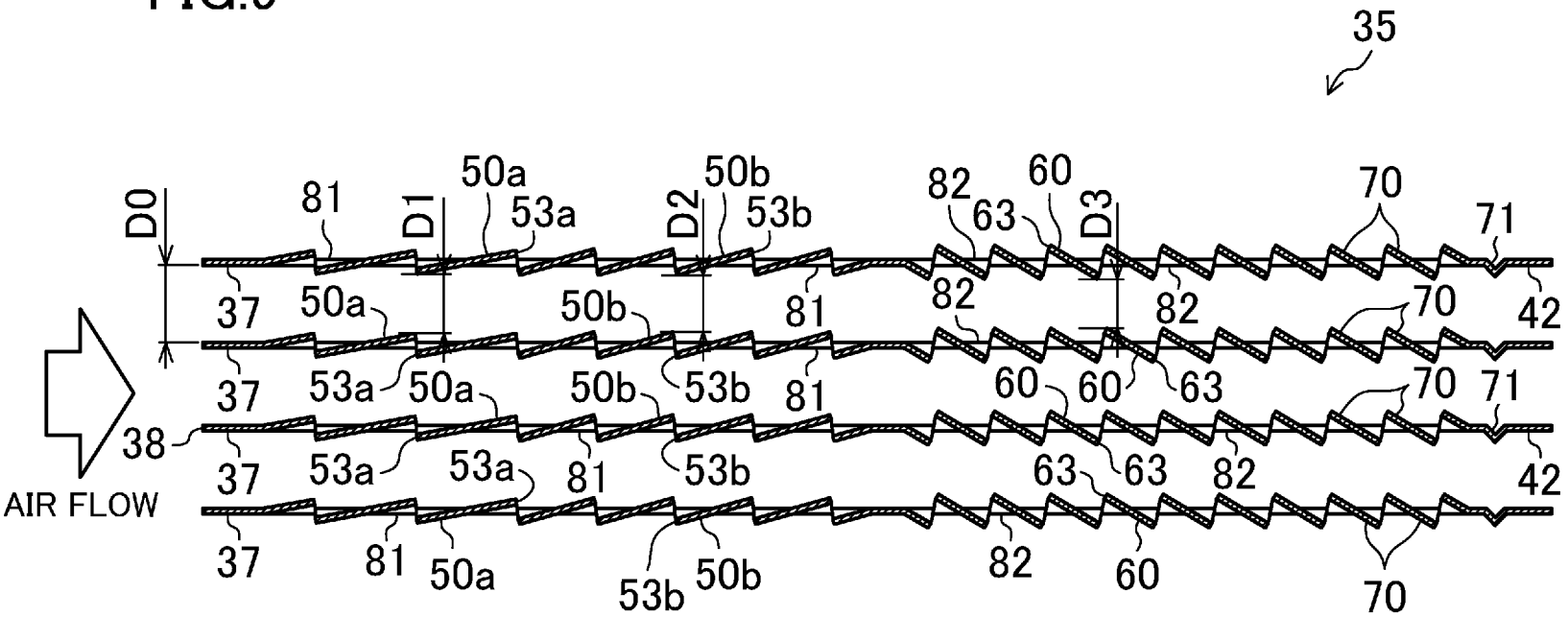
FIG. 9 is a cross-sectional view illustrating heat transfer parts provided in the fins of the heat exchanger of the first embodiment, and corresponding to FIG. 6B.

In the heat exchanger (30), the heat transfer parts (37) of the fins (35) are arranged at the same pitch along the direction in which the flat tubes (33) extend. Specifically, as illustrated in FIG. 9, in the heat exchanger (30), the heat transfer parts (37) are separated from one another by a distance D0 in the direction in which the flat tubes (33) extend. On the other hand, the bent-out heights of the windward louvers (50*a*, 50*b*) and the leeward louvers (60) have the relationship of H1<H2<H3. Thus, in two of the heat transfer parts (37) that are adjacent to each other in the direction in which the flat tubes (33) extend, the distance D1 between the windward louvers (50*a*) at the windward side is larger than the distance D2 between the windward louvers (50*b*) at the leeward side, and the distance D2 between the windward louvers (50*b*) at the leeward side is larger than the distance D3 between the leeward louvers (60) (i.e., D0>D1>D2>D3).

As illustrated in FIGS. 8A and 8B, the bent-out ends (53, 63) of the windward louvers (50) and the leeward louvers (60) include main edges (54, 64), upper edges (55, 65), and lower edges (56, 66). The main edges (54, 64) extend substantially in parallel with the direction in which the front edges (38) of the heat transfer parts (37) extend. The upper edges (55, 65) extend from the upper ends of the main edges (54, 64) to the upper ends of the louvers (50, 60), and are tilted relative to the main edges (54, 64). The lower edges (56, 66) extend from the lower ends of the main edges (54, 64) to the lower ends of the louvers (50, 60), and are tilted relative to the main edges (54, 64).

As illustrated in FIG. 8A, in each of the windward louvers (50), the upper edge (55) is tilted at a tilt angle θ4 relative to the main edge (54), and the lower edge (56) is tilted at a tilt angle θ5 relative to the main edge (54). As illustrated in FIGS. 6A and 6B, in each of the windward louvers (50), the tilt angle θ5 of the lower edge (56) is smaller than the tilt angle θ4 of the upper edge (55) (i.e., θ5<θ4). Thus, in each of the windward louvers (50), the lower edge (56) is longer than the upper edge (55). Each of the windward louvers (50) is an asymmetric louver in which the shape of the bent-out end (53) is asymmetric in the vertical direction.

FIG. 8A illustrates the windward louvers (50*b*) located at the leeward side. As also illustrated in FIG. 7A, these windward louvers (50*b*) have the bent-out height H2. As also illustrated in FIG. 9, between each two of the heat transfer parts (37) adjacent to each other in the air passage direction, the windward louvers (50*b*) are separated from each other by the distance D2.

As illustrated in FIG. 8B, in each of the leeward louvers (60), the upper edge (65) is tilted at a tilt angle θ6 relative to the main edge (64), and the lower edge (66) is tilted at a tilt angle θ7 relative to the main edge (64). As illustrated in FIGS. 6A and 6B, in the two leeward louvers (60*a*) located at the windward side, the tilt angle θ6 of the lower edge (66) is smaller than the tilt angle θ7 of the upper edge (65) (i.e., θ6<θ7). Thus, in each of the leeward louvers (60*a*), the lower edge (66) is longer than the upper edge (65). The leeward louvers (60*a*) are asymmetric louvers in each of which the shape of the bent-out end (63) is asymmetric in the vertical direction. On the other hand, in the three leeward louvers (60*b*) located at the leeward side, the tilt angle θ6 of the lower edge (66) is equal to the tilt angle θ7 of the upper edge (65) (i.e., θ6=θ7). Thus, in each of these leeward louvers (60*b*), the length of the lower edge (66) is equal to that of the upper edge (65). The leeward louvers (60*b*) are symmetric louvers in each of which the shape of the bent-out end (63) is symmetric in the vertical direction.

FIG. 8B illustrates the leeward louvers (60*b*) located at the leeward side. As also illustrated in FIG. 7B, the leeward louvers (60*b*) have the bent-out height H3. As also illustrated in FIG. 9, between each two of the heat transfer parts (37) adjacent to each other in the air passage direction, the leeward louvers (60*b*) are separated from each other by the distance D3.

—Conditions of Frost and Drain Water in Defrost Operation—

As described above, the heat exchanger (30) of this embodiment constitutes the outdoor heat exchanger (23) of the air conditioner (10). The air conditioner (10) performs heating operation. In an operating state where the evaporating temperature of refrigerant in the outdoor heat exchanger (23) is less than 0° C., moisture in the outdoor air becomes frost to be attached to the outdoor heat exchanger (23). Thus, the air conditioner (10) performs defrosting operation in order to melt the frost attached to the outdoor heat exchanger (23). During the defrosting operation, drain water is generated due to melting of the frost.

Figure 10:
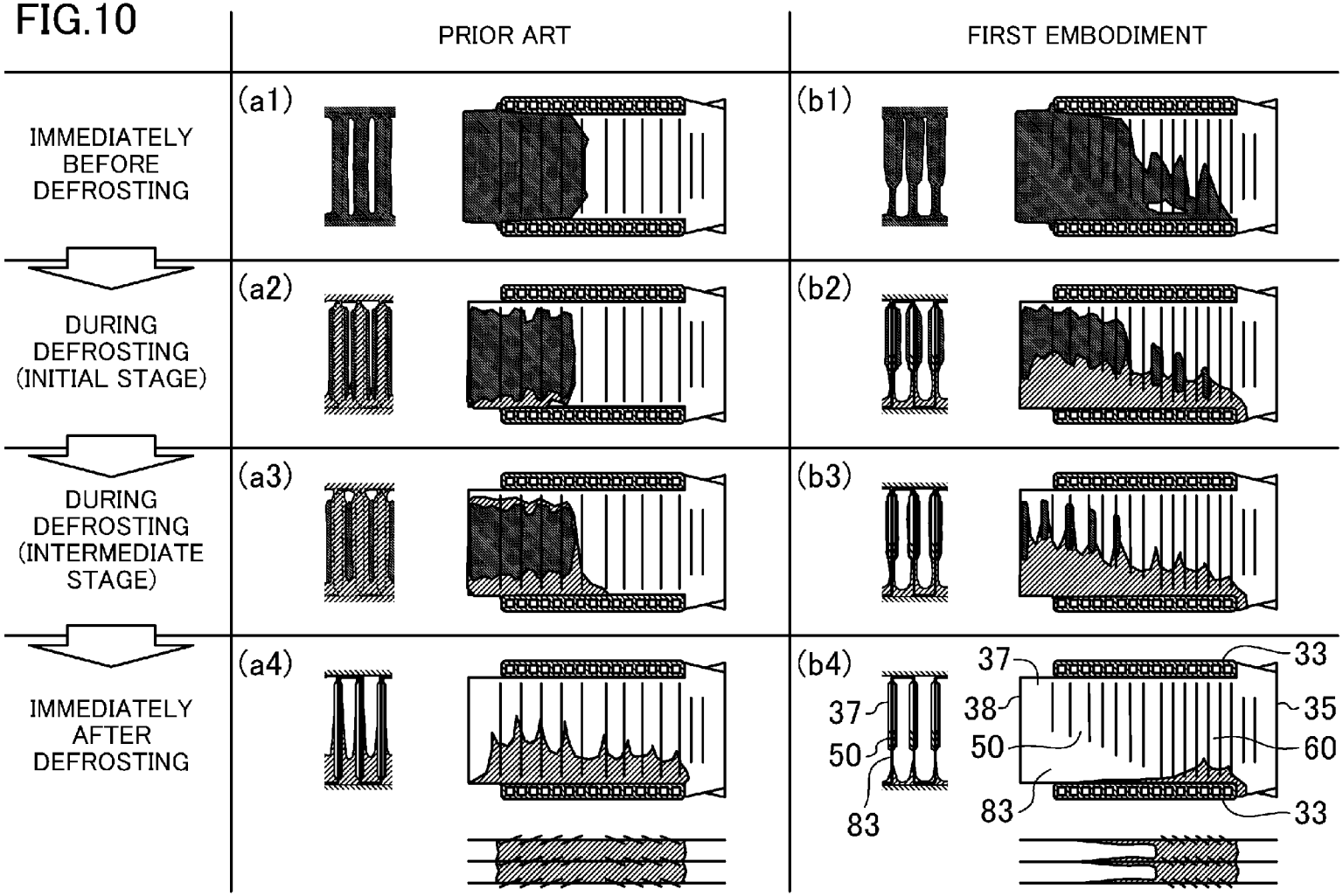
FIG. 10 is a view illustrating conditions of frost and drain water in defrosting operation in the heat exchanger of the first embodiment and a conventional heat exchanger.

Referring now to FIG. 10, conditions of frost and drain water from the time immediately before the start of defrosting operation to the time immediately after the end of the defrosting operation will be described. Here, conditions of frost and drain water in the heat exchanger (30) of this embodiment will be described in comparison with conditions of frost and drain water in a conventional heat exchanger. In this conventional heat exchanger, all the louvers are provided substantially across the entire width of heat transfer parts, and have an identical bent-out height.

Immediately before the start of defrosting operation, a large amount of frost is attached to the heat transfer parts (37) of the fins to almost fill a gap between adjacent ones of the heat transfer parts (37).

As illustrated in a section (a1) of FIG. 10, in the conventional heat exchanger, frost is collectively attached to a windward region of the fins, and hinders an airflow through the heat exchanger and heat exchange between the air and refrigerant. To prevent this, the conventional heat exchanger needs to perform defrosting operation although frost is hardly attached to a leeward region of the fins.

On the other hand, as illustrated in a section (b1) of FIG. 10, in the heat exchanger (30) of this embodiment, frost is also attached to a leeward region of the heat transfer parts (37). In a windward region of the heat transfer parts (37), a gap through which air flows is filled with frost in an upper portion where the windward louvers (50) are provided, but a gap through which air flows remains in a portion below the windward louvers (50). Accordingly, in the heat exchanger (30) of this embodiment, frost is also attached to a portion of the heat transfer parts (37) where the leeward louvers (60) are provided.

In addition, in the heat exchanger (30) of this embodiment, the bent-out height H3 of the leeward louvers (60) is larger than the bent-out heights H1 and H2 of the windward louvers (50). Accordingly, a large area of the leeward louvers (60) located behind the windward louvers (50) can also be exposed to wind, resulting in an increase in the amount of frost attached to the leeward louvers (60).

In this manner, in the heat exchanger (30) of this embodiment, frost is attached not only to a windward region of the fins (35) but also to a leeward region of the fins (35). Thus, the amount of frost attached to the heat exchanger (30) at the time when defrosting operation is needed, is larger in the heat exchanger (30) of this embodiment than in the conventional heat exchanger. Accordingly, as compared to an air conditioner including an outdoor heat exchanger constituted by the conventional heat exchanger, the air conditioner (10) including the outdoor heat exchanger (23) constituted by the heat exchanger (30) of this embodiment can prolong the time interval from the end of defrosting operation to the start of next defrosting operation, resulting in an increase in time duration of heating operation.

Once defrosting operation is started, frost attached to the heat exchanger (30) is heated by refrigerant and gradually melts.

As illustrated in sections (a2) and (a3) in FIG. 10, in the conventional heat exchanger, drain water is accumulated in the periphery of remaining frost. In the conventional heat exchanger, all the louvers are provided substantially across the entire width of the heat transfer parts, and a gap between adjacent ones of the heat transfer parts is small substantially in the entire part of a windward region of the heat transfer parts. Thus, drain water generated due to melting of frost is held in the gap between the adjacent heat transfer parts, and hardly flows out of the periphery of the frost. Once drain water is accumulated in the periphery of frost, the frost floats in the drain water, causing the frost to be separated from the surfaces of the heat transfer parts.

On the other hand, as illustrated in sections (b2) and (b3) of FIG. 10, in the heat exchanger (30) of this embodiment, drain water generated flows down, and is not accumulated in the periphery of remaining frost. In the heat exchanger (30) of this embodiment, the lower ends of the windward louvers (50) are located above the lower ends of the leeward louvers (60). Accordingly, the gap between adjacent ones of the heat transfer parts (37) is wide in a region below the windward louvers (50). Thus, drain water generated due to melting of frost attached to the windward louvers (50) quickly flows down along the first lower flat parts (83). Once the drain water is quickly discharged from the periphery of the frost, the frost is kept being in contact with the surfaces of the heat transfer parts (37).

In this manner, in the heat exchanger (30) of this embodiment, drain water generated during defrosting operation is quickly discharged from the periphery of the windward louvers (50) to which a relatively large amount of frost is attached. Thus, frost remaining on the periphery of the windward louvers (50) is kept being in contact with the surfaces of the heat transfer parts (37). In this state, if remaining frost floated in drain water and was removed from the heat transfer parts as in the conventional heat exchanger, thermal transfer from the transmission parts to the frost would be inhibited by the drain water, resulting in an increase in the time necessary for melting the frost. On the other hand, in the heat exchanger (30) of this embodiment, remaining frost is kept being in contact with the surfaces of the heat transfer parts (37), and heat is transferred from the heat transfer parts (37) to the frost without being inhibited by the drain water. Accordingly, as compared to the air conditioner including the outdoor heat exchanger constituted by the conventional heat exchanger, the air conditioner (10) including the outdoor heat exchanger (23) constituted by the heat exchanger (30) of this embodiment can reduce time duration (i.e., the time during which heating operation is interrupted) of defrosting operation.

In general, no frost remains but drain water is present in the heat exchanger (30) immediately after defrosting operation.

As illustrated in a section (a4) of FIG. 10, in the conventional heat exchanger (30), a relatively large amount of drain water is accumulated near the lower ends of the heat transfer parts (37) of the fins. In the conventional heat exchanger (30), all the louvers are provided substantially across the entire width of heat transfer parts (37), and a gap between adjacent ones of the heat transfer parts (37) is narrow. The upper side surfaces of the flat tubes (33) are substantially horizontal. Thus, drain water generated during defrosting operation is kept in the gap between the adjacent heat transfer parts (37), and accumulated on the upper surfaces of the flat tubes (33).

On the other hand, as illustrated in a section (b4) of FIG. 10, in the heat exchanger (30) of this embodiment, a large part of the drain water generated during defrosting operation moves leeward, and is discharged downward along the projecting plate part (42). In the heat exchanger (30) of this embodiment, the lower ends of the leeward louvers (60) are located below the lower ends of the windward louvers (50). Accordingly, a gap between adjacent ones of the heat transfer parts (37) is narrow in a region below the leeward louvers (60). Drain water accumulated on the upper surfaces of the flat tubes (33) is drawn leeward by a capillary phenomenon. That is, although the outdoor fans (15) are halted during defrosting operation and the upper surfaces of the flat tubes (33) are substantially horizontal, drain water moves leeward.

In this manner, in the heat exchanger (30) of this embodiment, drain water generated during defrosting operation hardly remains on the surfaces of the heat transfer parts (37). If drain water remained on the surfaces of the heat transfer parts (37), drain water remaining would be frozen after restart of heating operation, resulting in reduction in the time until defrosting operation is needed again. Thus, as compared to the air conditioner including the outdoor heat exchanger constituted by the conventional heat exchanger, the air conditioner (10) including the outdoor heat exchanger (23) constituted by the heat exchanger (30) of this embodiment can prolong the period from the end of defrosting operation to the start of next defrosting operation (i.e., time duration of heating operation).

Figure 11:
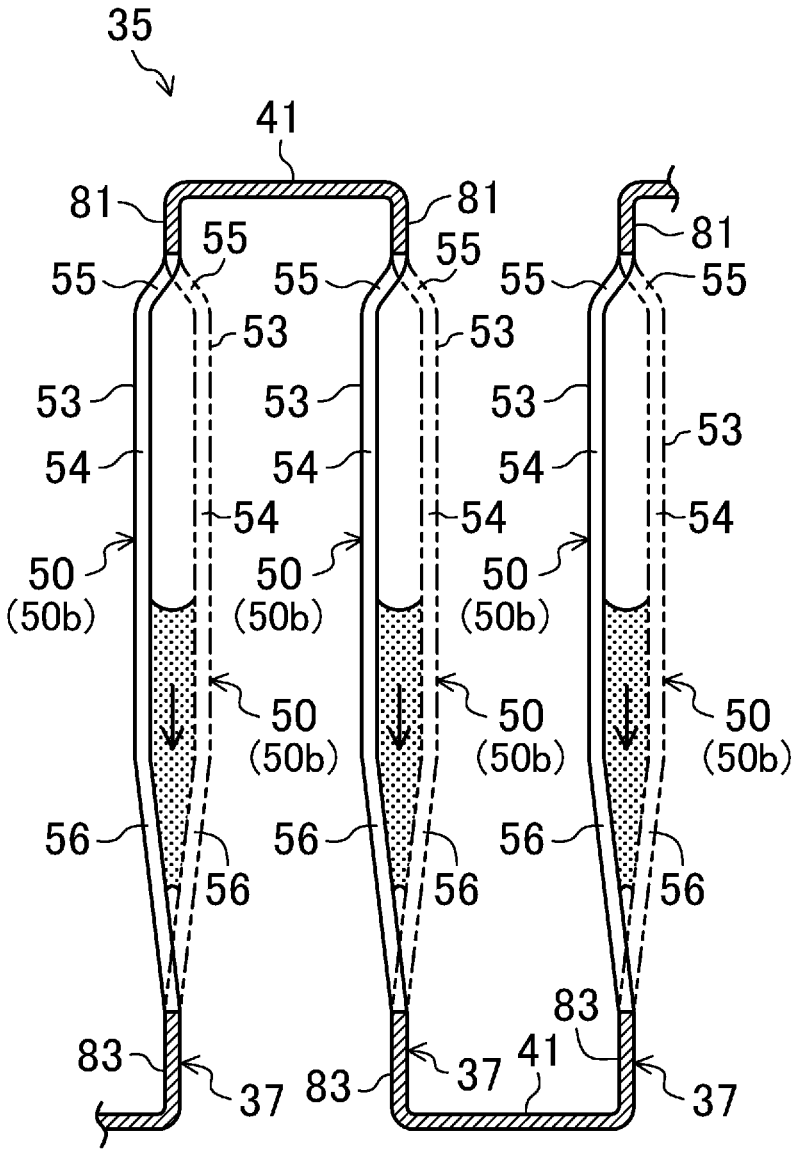
FIG. 11 is a cross-sectional view illustrating the fin taken along the line E-E in FIGS. 6A and 6B.

As described above, in the heat exchanger (30) of this embodiment, the tilt angle θ5 of the lower edges (56) of the windward louvers (50) is smaller than the tilt angle θ4 of the upper edges (55) thereof (see FIG. 8A). Thus, as illustrated in FIG. 11, between the windward louvers (50) that are adjacent to each other in the air passage direction, a gap between the lower edges (56) is more slender than a gap between the upper edges (55).

In general, liquid in a relatively narrow gap has a relatively large capillary force. The capillary force of liquid increases as the gap becomes narrower. As illustrated in FIG. 11, in a state where drain water is present between the bent-out ends (53) of the windward louvers (50) that are adjacent to each other in the air passage direction, the gap between the lower edges (56) that are in contact with the lower end of the drain water is narrower than the gap between the main edges (54) that are in contact with the upper end of the drain water. Accordingly, downward capillary force of the drain water is larger than upward capillary force thereof, thereby causing the drain water to be drawn toward the lower edges (56) (i.e., downward).

As described above, the windward louvers (50) are asymmetric louvers in each of which the shape of the bent-out end (53) is asymmetric in the vertical direction and the lower edge (56) is relatively long. Thus, between the windward louvers (50) that are adjacent to each other in the air passage direction, a narrow gap between the bent-out ends (53) is enlarged. Consequently, a region where downward capillary force of the drain water is larger than upward capillary force thereof is enlarged, resulting an increase in the possibility of downward movement of the drain water due to a capillary phenomenon.

In this manner, drain water between the bent-out ends (53) of the windward louvers (50) that are adjacent to each other in the air passage direction is drawn into a slender narrow gap between the lower edges (56) due to a capillary phenomenon. That is, the drain water flows down due to not only gravity but also a capillary phenomenon. Accordingly, drain water generated near the windward louvers (50) during defrosting operation is quickly discharged downward, and is less likely to be held between the bent-out ends (53) of the windward louvers (50) that are adjacent to each other in the air passage direction.

In addition, in the heat exchanger (30) of this embodiment, the leeward louvers (60*a*) located at the windward side are also asymmetric louvers in which the tilt angle θ7 of the lower edges (56) is smaller than the tilt angle θ6 of the upper edge (55) (see FIGS. 6A and 6B). Thus, in the same manner as in the windward louvers (50), drain water flows down between adjacent ones of the leeward louvers (60*a*) due to both gravity and a capillary phenomenon.

Advantages of First Embodiment

As described above, in the heat exchanger (30) of this embodiment, in heating operation of the air conditioner (10), frost can be attached not only to a windward region but also to a leeward region in the heat transfer parts (37) of the fins (35). Thus, the outdoor heat exchanger (23) of the air conditioner (10) constituted by the heat exchanger (30) of this embodiment can prolong time duration of heating operation.

In addition, in the heat exchanger (30) of this embodiment, drain water generated during defrosting operation of the air conditioner (10) can be quickly discharged from the surfaces of the heat transfer parts (37) of the fins (35). Thus, a sufficient amount of heat can be transmitted from the heat transfer parts (37) to frost. Thus, the outdoor heat exchanger (23) of the air conditioner (10) constituted by the heat exchanger (30) of this embodiment can reduce time necessary for defrosting operation.

Further, the heat exchanger (30) of this embodiment can reduce the amount of drain water remaining on the surfaces of the heat transfer parts (37) at the end of defrosting operation. Drain water remaining on the surfaces of the heat transfer parts (37) is frozen after restart of heating operation. Accordingly, reduction of drain water remaining on the surfaces of the heat transfer parts (37) can prolong the period until next defrosting operation is needed. Thus, the outdoor heat exchanger (23) of the air conditioner (10) constituted by the heat exchanger (30) of this embodiment can prolong time duration of heating operation.

In this manner, the outdoor heat exchanger (23) of the air conditioner (10) constituted by the heat exchanger (30) of this embodiment can prolong time duration of heating operation, and reduce the time necessary for defrosting operation. Thus, the outdoor heat exchanger (23) of the air conditioner (10) constituted by the heat exchanger (30) of this embodiment can enhance the mean value, in terms of time, of heating capacity of the air conditioner (10) (i.e., substantial heating capacity of the air conditioner (10)).

Second Embodiment

A second embodiment of the present disclosure will be described. In the same manner as the heat exchanger (30) of the first embodiment, a heat exchanger (30) according to the second embodiment constitutes an outdoor heat exchanger (23) of an air conditioner (10). The heat exchanger (30) of this embodiment will now be described with reference to FIGS. 12-18.

<Overall Configuration of Heat Exchanger>

Figure 12:
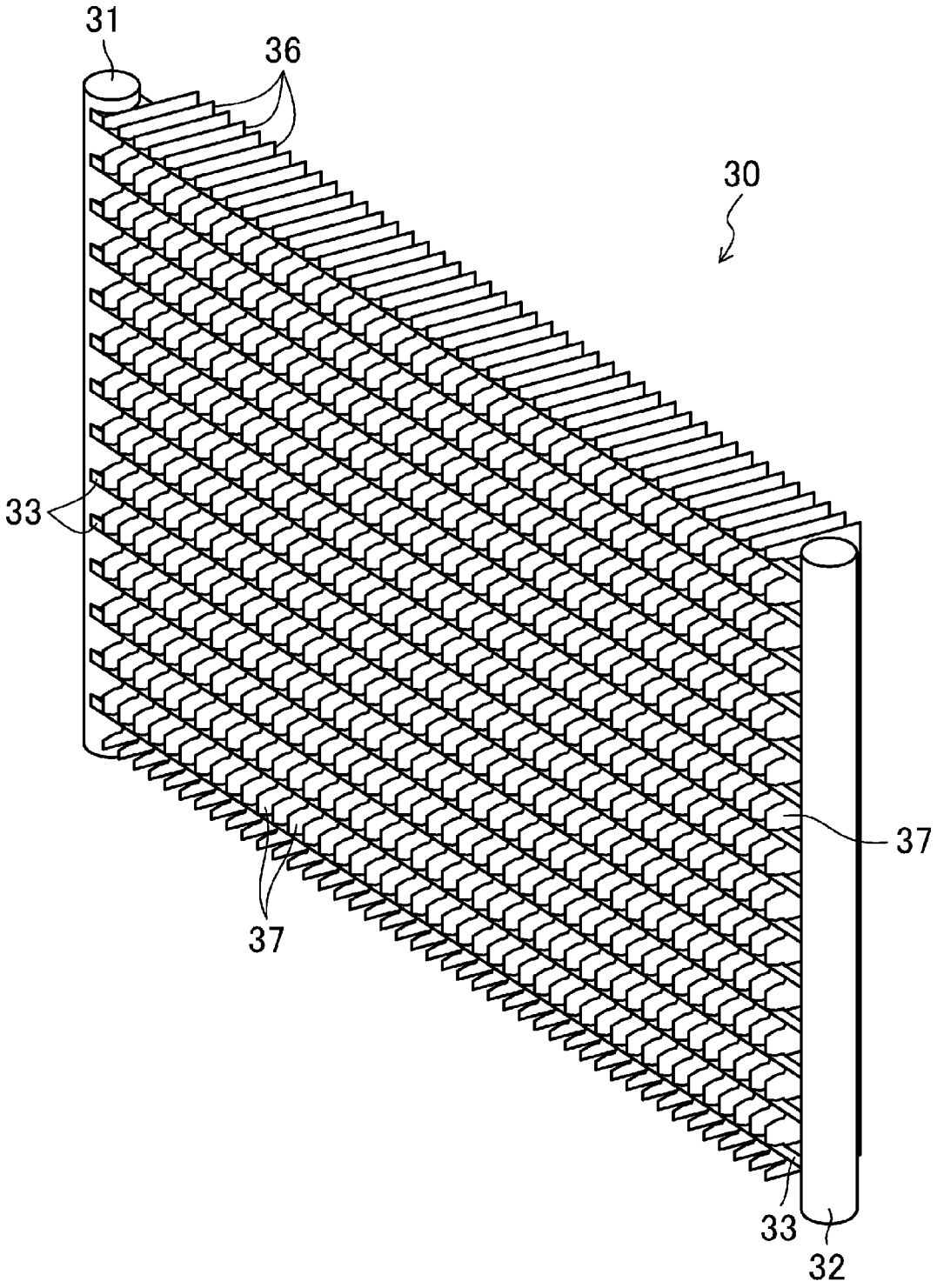
FIG. 12 is a perspective view schematically illustrating a heat exchanger according to a second embodiment.
Figure 13:
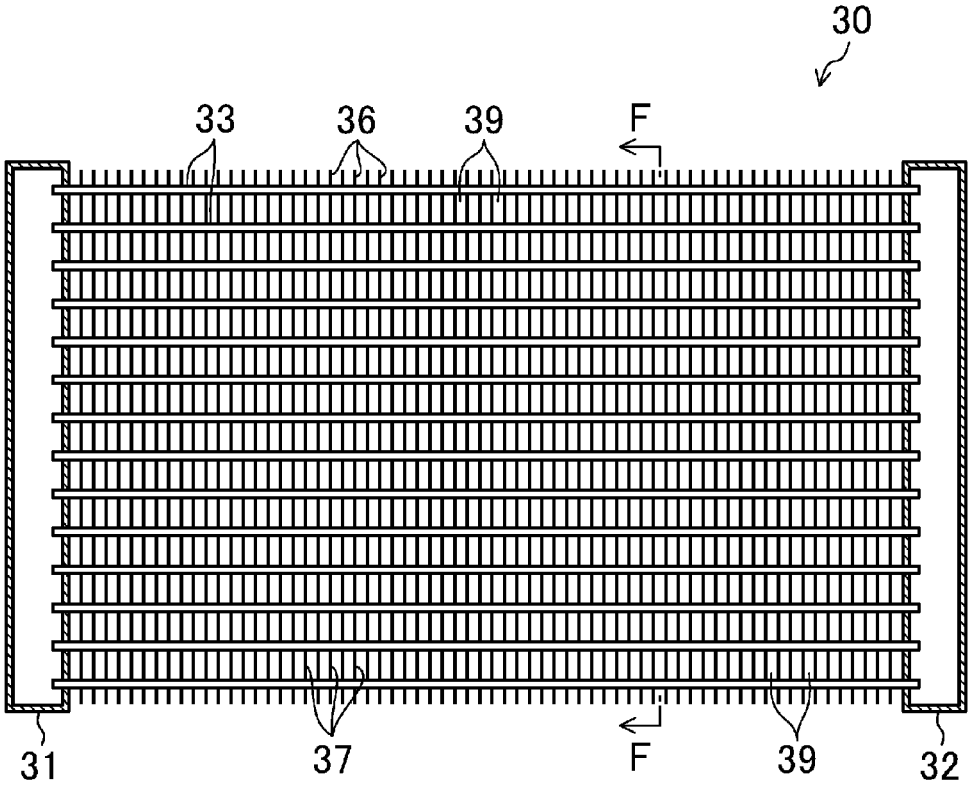
FIG. 13 is a partial cross-sectional view illustrating the heat exchanger of the second embodiment when viewed from the front.

As illustrated in FIGS. 12 and 13, the heat exchanger (30) of this embodiment includes a first header concentrated pipe (31), a second header concentrated pipe (32), a large number of flat tubes (33), and a large number of fins (36). The first header concentrated pipe (31), the second header concentrated pipe (32), the flat tubes (33), and the fins (36) are made of an aluminium alloy, and are joined to one another by brazing.

The configurations and layouts of the first header concentrated pipe (31), the second header concentrated pipe (32), and flat tubes (33) are the same as those of the heat exchanger (30) of the first embodiment. Specifically, each of the first header concentrated pipe (31) and the second header concentrated pipe (32) has a slender cylindrical shape. One of the first header concentrated pipe (31) or the second header concentrated pipe (32) is located at the left end of the heat exchanger (30), and the other is located at the right end of the heat exchanger (30). The flat tubes (33) are heat transfer tubes having flat shapes in cross section, and are arranged in the vertical direction with their flat side surfaces face one another. Each of the flat tubes (33) includes a plurality of fluid passages (34). Each of the vertically arranged flat tubes (33) is inserted in the first header concentrated pipe (31) at one end, and in the second header concentrated pipe (32) at the other end.

The fins (36) are plate-like fins, and are spaced from one another by a predetermined distance in the direction in which the flat tubes (33) extend. That is, the fins (36) are substantially orthogonal to the direction in which the flat tubes (33) extend. Although specifically described later, in each of the fins (36), a portion between vertically adjacent ones of the flat tubes (33) constitutes a heat transfer part (37).

As illustrated in FIG. 13, in the heat exchanger (30), a space between vertically adjacent ones of the flat tubes (33) is divided into a plurality of air passages (39) by the heat transfer parts (37) of the fins (36). The heat exchanger (30) performs heat exchange between refrigerant flowing in the fluid passages (34) of the flat tubes (33) and air flowing in the air passages (39).

As described above, the heat exchanger (30) includes: the vertically arranged flat tubes (33) whose flat side surfaces face one another; and the fins (36) including the plate-like heat transfer parts (37) each extending from one of its adjacent flat tubes (33) to the other. The heat transfer parts (37) are located between adjacent ones of the flat tubes (33), and arranged in the direction in which the flat tubes (33) extend. In the heat exchanger (30), air flowing between adjacent ones of the heat transfer parts (37) exchanges heat with fluid flowing in the flat tubes (33).

<Fin Configuration>

Figure 14:
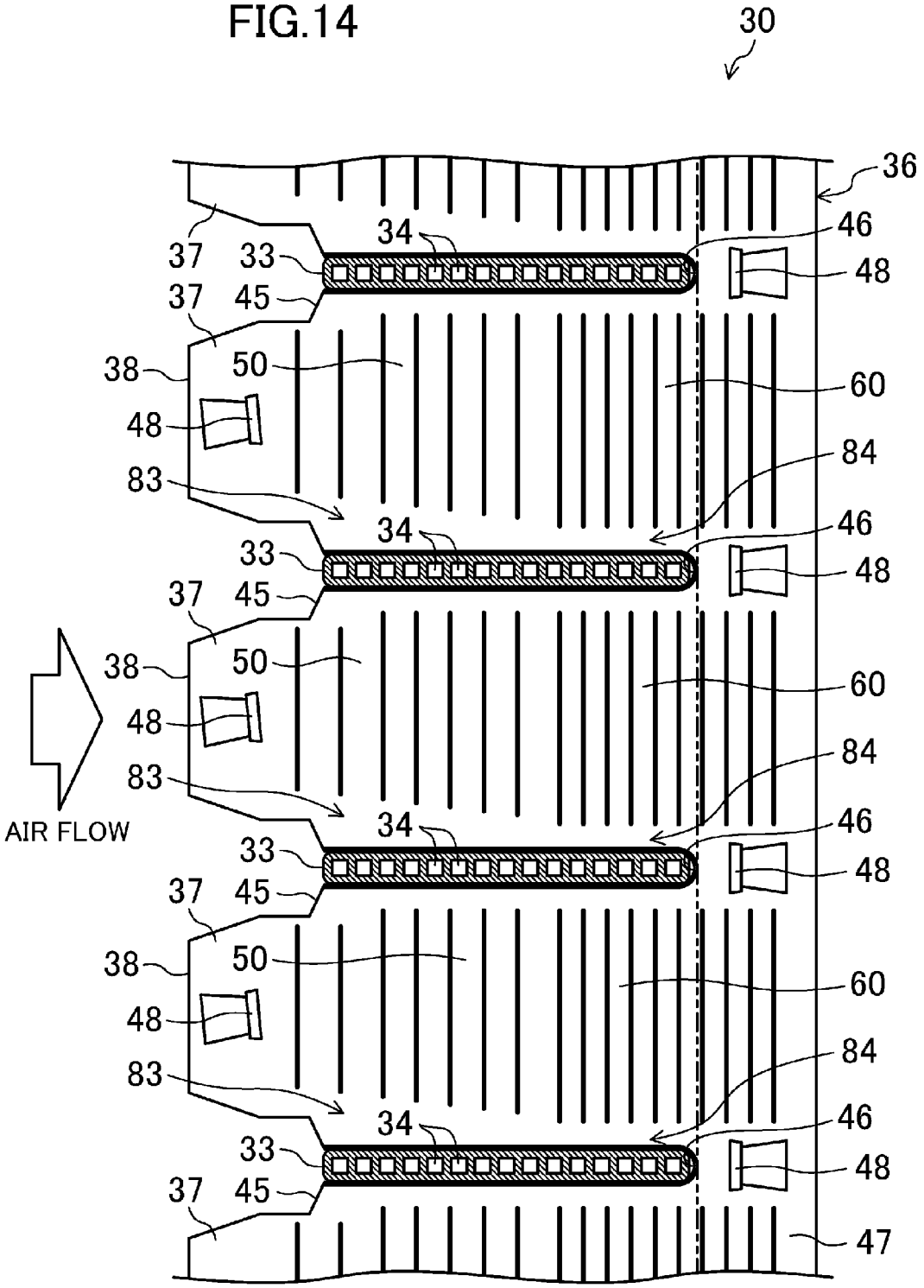
FIG. 14 is a cross-sectional view partially illustrating the heat exchanger taken along the line F-F in FIG. 13.

As illustrated in FIG. 14, each of the fins (36) is an elongate plate-like fin formed by pressing a metal plate. The thickness of each of the fins (36) is approximately 0.1 mm.

Each of the fins (36) has a large number of slender notches (45) extending from a front edge (38) of the fin (36) in the width direction of the fin (36). In each of the fins (36), a large number of notches (45) are spaced from one another by a predetermined distance in the longitudinal direction (i.e., the vertical direction) of the fin (36). The notches (45) are notches into which the flat tubes (33) are inserted. Leeward portions of the notches (45) constitute pipe insertion portions (46). The vertical width of the pipe insertion portions (46) is substantially equal to the thickness of the flat tubes (33), and the length of the pipe insertion portions (46) is substantially equal to the width of the flat tubes (33).

The flat tubes (33) are inserted into the pipe insertion portions (46) of the fins (36), and joined to the peripheries of the pipe insertion portions (46) by brazing. That is, each of the flat tubes (33) is sandwiched between the periphery of an associated one of the pipe insertion portions (46), which are part of the notches (45).

In the fins (36), portions between vertically adjacent ones of the notches (45) constitute heat transfer parts (37), and portions at the leeward side of the pipe insertion portions (46) constitute leeward plate portions (47). That is, each of the fins (36) includes: the heat transfer parts (37) vertically adjacent ones of which sandwich an associated one of the flat tubes (33); and the leeward plate portion (47) continuous to the leeward sides of the heat transfer parts (37). In the heat exchanger (30) of this embodiment, the heat transfer parts (37) of each of the fins (36) are disposed between the vertically arranged flat tubes (33), and the leeward plate portion (47) projects leeward from the flat tubes (33).

Figure 15A:
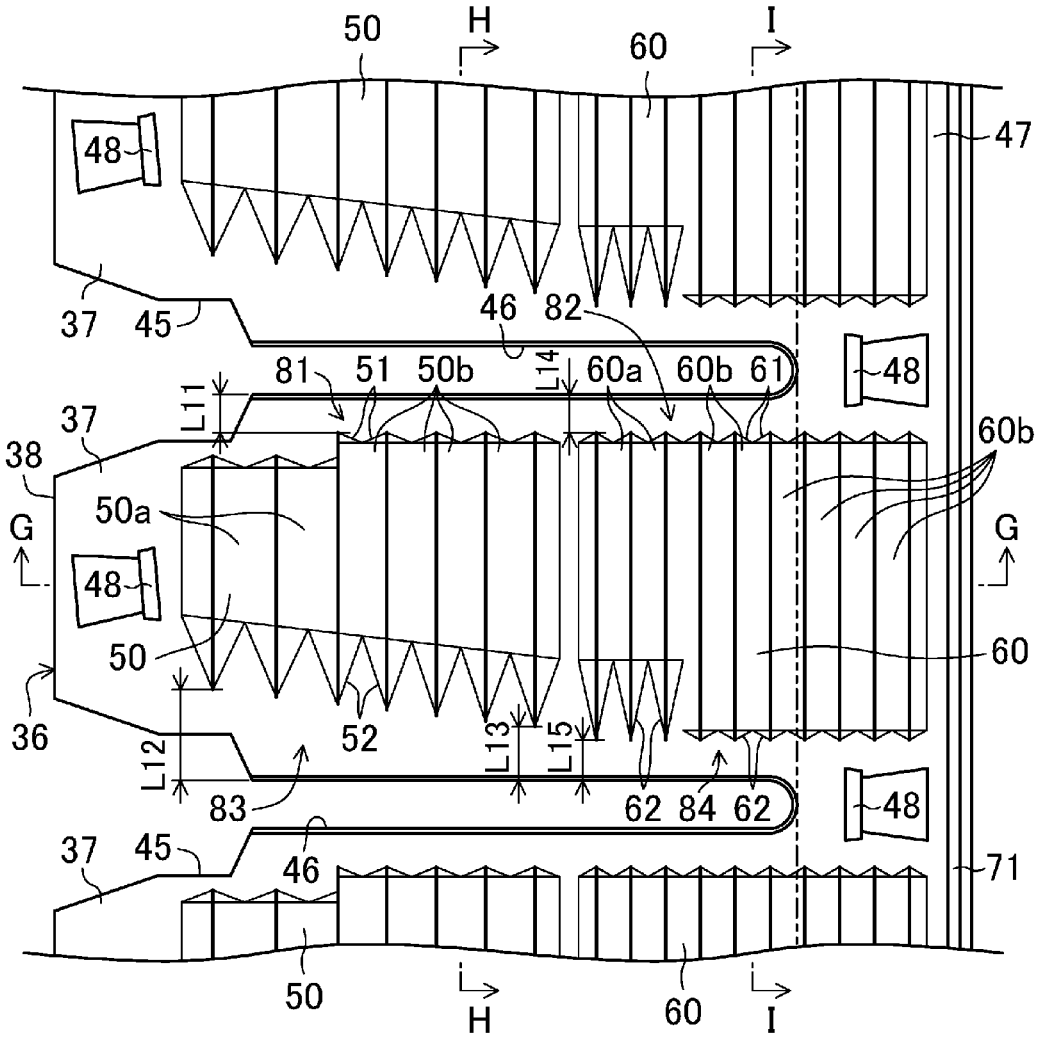
FIGS. 15A and 15B are views illustrating a main portion of a fin of the heat exchanger of the second embodiment.
Figure 15B:
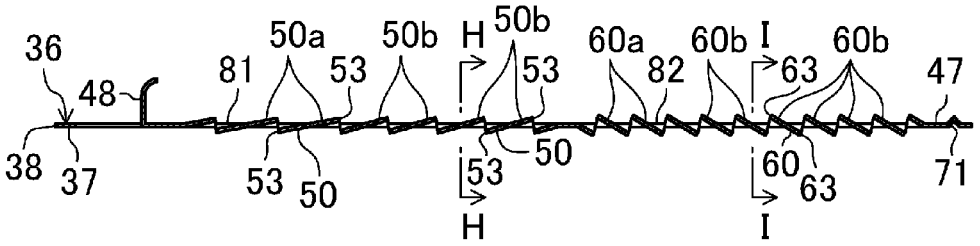

As illustrated in FIGS. 15A and 15B, a plurality of louvers (50, 60) are provided in each of the heat transfer parts (37) and the leeward plate portion (47) of each of the fins (36). The louvers (50, 60) bend out from the heat transfer part (37) and the leeward plate portion (47). That is, the louvers (50, 60) are obtained by forming slits in the heat transfer part (37) and the leeward plate portion (47) and plastically deforming portions between adjacent ones of the slits.

The longitudinal direction of the louvers (50, 60) are substantially in parallel with the front edge (38) of the heat transfer part (37). That is, the longitudinal direction of the louvers (50, 60) coincides with the vertical direction. In the heat transfer part (37), the louvers (50, 60) extending in the vertical direction are arranged side by side from the windward to the leeward.

In the heat transfer part (37), six louvers located in a windward region are windward louvers (50). That is, in the heat transfer part (37), six adjacent louvers including the louver closest to the windward side are the windward louvers (50). In addition, the other nine louvers located at the leeward side of the windward louvers (50) are leeward louvers (60). The leeward louvers (60) are provided in a region extending from a leeward region of the heat transfer part (37) to the leeward plate portion (47).

In this manner, the six windward louvers (50) and the nine leeward louvers (60) are arranged in this order from the windward side to the leeward side in the heat transfer part (37) and the leeward plate portion (47). The numbers of the louvers (50, 60) described above are merely examples. The shapes of the louvers (50, 60) will be described in detail later.

Portions of the heat transfer part (37) of the fin (36) located above or below the louvers (50, 60) are flat without bending and unevenness.

Specifically, in the heat transfer part (37), a flat regions between the upper end of the heat transfer part (37) and the windward louvers (50) is a first upper flat part (81), and a flat region between the upper end of the heat transfer part (37) and the leeward louvers (60) is a second upper flat part (82). The first upper flat part (81) is continuous to the windward louvers (50), and adjacent to crests (51) at the upper ends of the windward louvers (50). The second upper flat part (82) is continuous to the leeward louvers (60), and adjacent to crests (61) at the upper ends of the leeward louvers (60).

In the heat transfer part (37), a flat regions between the lower end of the heat transfer part (37) and the windward louvers (50) is a first lower flat part (83), and a flat region between the lower end of the heat transfer part (37) and the leeward louvers (60) is a second lower flat part (84). The first lower flat part (83) is continuous to the windward louvers (50), and adjacent to crests (52) located at the lower ends of the windward louvers (50). The second lower flat parts (84) are continuous to the leeward louvers (60), and adjacent to crests (62) at the lower ends of the leeward louvers (60).

The leeward plate portion (47) of the fin (36) includes a water-conveyance rib (71). The water-conveyance rib (71) is a slender groove extending in the vertical direction from the upper end to the lower end of the leeward plate portion (47) along the leeward side of the leeward plate portion (47).

Figure 18:
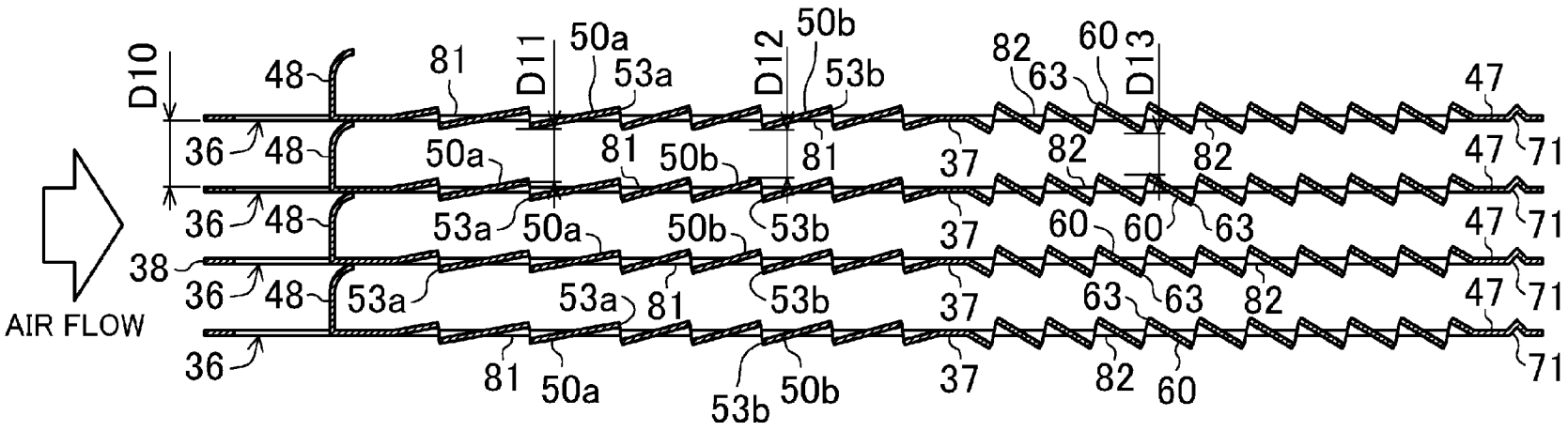
FIG. 18 is a cross-sectional view illustrating heat transfer parts provided in fins of the heat exchanger of the second embodiment, and corresponds to FIG. 15B.

Each of the fin (36) includes tabs (48) for keeping the distance from its adjacent fin (36). As illustrated in FIG. 15B, the tabs (48) are rectangular flaps formed by bending out the fin (36). As illustrated in FIG. 18, the tabs (48) keep the distance between the fins (36) with the tips of the tabs (48) being in contact with their adjacent ones of the fins (36). As illustrated in FIGS. 14, 15A, and 15B, in each of the fins (36), each of the heat transfer parts (37) has one tab (48), and the leeward plate portion (47) has a plurality of tabs (48). In each of the heat transfer parts (37), the tab (48) is located windward of the windward louvers (50). In the leeward plate portion (47), one tab (48) is located at the leeward side of the pipe insertion portion (46).

<Louver Shape>

The shapes of the louvers (50, 60) formed in the fins (36) are described in detail. The "right" and "left" herein are based on the direction when the fins (36) are seen from the windward side (i.e., from the front side of the heat exchanger (30)).

As illustrated in FIGS. 15A and 15B, the length from the upper ends of four windward louvers (50*b*) located at the leeward side to the upper end of the heat transfer part (37) is L11. The upper ends of two windward louvers (50*a*) located at the windward side are slightly below the upper ends of the other four windward louvers (50*b*). The vertical positions of the lower ends of the windward louvers (50) gradually become lower from the windward side to the leeward side. Thus, the length L12 from the lower end of the windward louver (50) closest to the windward side to the lower end of the heat transfer part (37) is larger than the length L13 from the lower end of the windward louver (50) closest to the leeward side to the lower end of the heat transfer part (37) (i.e., L12>L13). The length L11 from the upper ends of the windward louvers (50) to the upper end of the heat transfer part (37) is smaller than the length L13 from the lower end of the windward louver (50) closest to the leeward side to the lower end of the heat transfer part (37) (i.e., L13>L11).

The leeward louvers (60) have the same vertical length. The leeward louvers (60) are longer than the windward louver (50) closest to the leeward side. The length L14 from the upper ends of the leeward louvers (60) to the upper end of the heat transfer part (37) is uniform. The length L14 is equal to the length L11 from the upper ends of the windward louvers (50) to the upper end of the heat transfer part (37). Thus, the length L15 from the lower ends of the leeward louvers (60) to the lower end of the heat transfer part (37) is smaller than the length L13 from lower end of the windward louver (50) closest to the leeward side to the lower end of the heat transfer part (37) (i.e., L13>L15).

The windward louvers (50) and the leeward louvers (60) having the above-described lengths are formed in the heat transfer part (37). As described above, in the heat transfer part (37), the first lower flat part (83) is formed below the windward louvers (50), and the second lower flat part (84) is formed below the leeward louvers (60). Thus, in the heat transfer part (37), the width, in the vertical direction, of the first lower flat part (83) is larger than that of the second lower flat part (84).

Figure 17A:
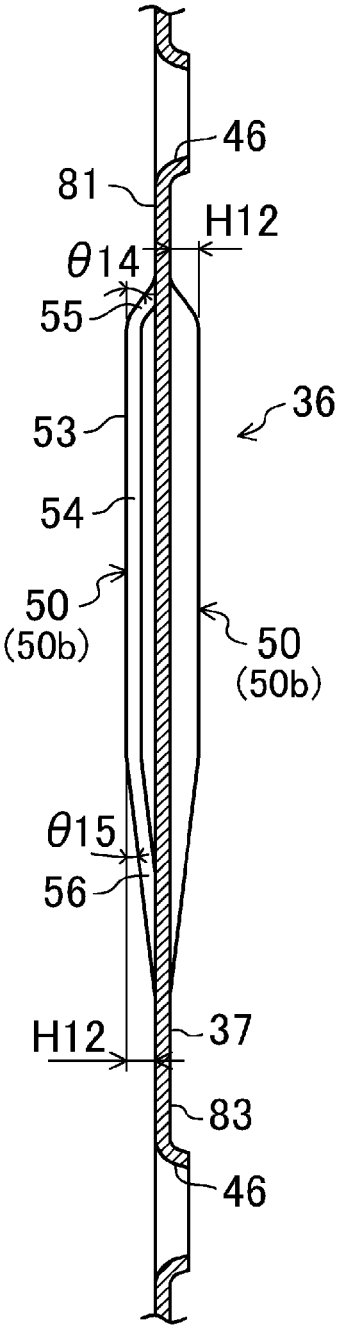
FIGS. 17A and 17B are cross-sectional views illustrating a fin provided in the heat exchanger of the second embodiment.
Figure 17B:
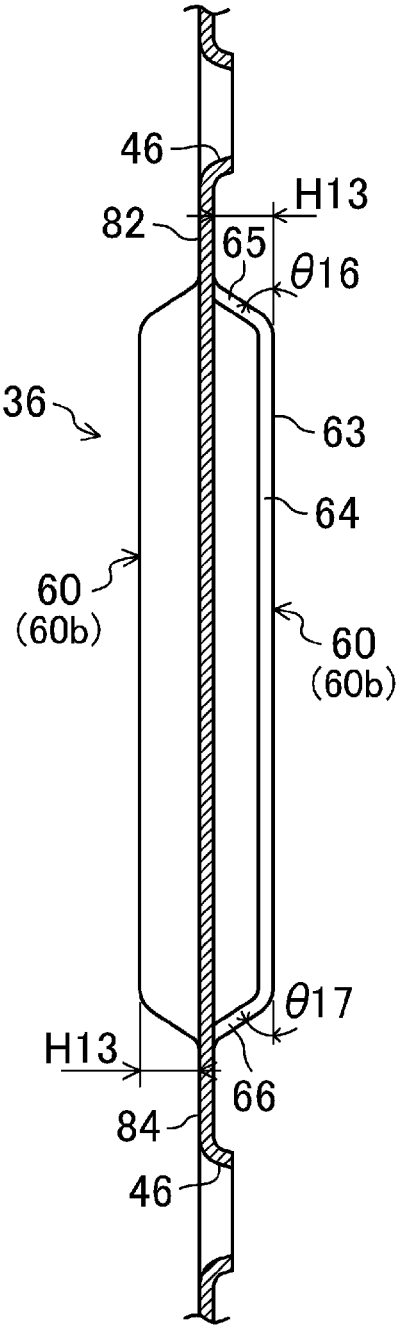

As illustrated in FIG. 15B, the louvers (50, 60) are tilted relative to flat portions (81-84). The windward louvers (50) and the leeward louvers (60) are tilted in opposite directions. As also illustrated in FIGS. 17A and 17B, in the windward louvers (50), windward bent-out ends (53) protrude to the left, and leeward bent-out ends (53) protrude to the right. In the leeward louvers (60), windward bent-out ends (63) protrude to the right, and leeward bent-out ends (63) protrude to the left.

Figure 16A:
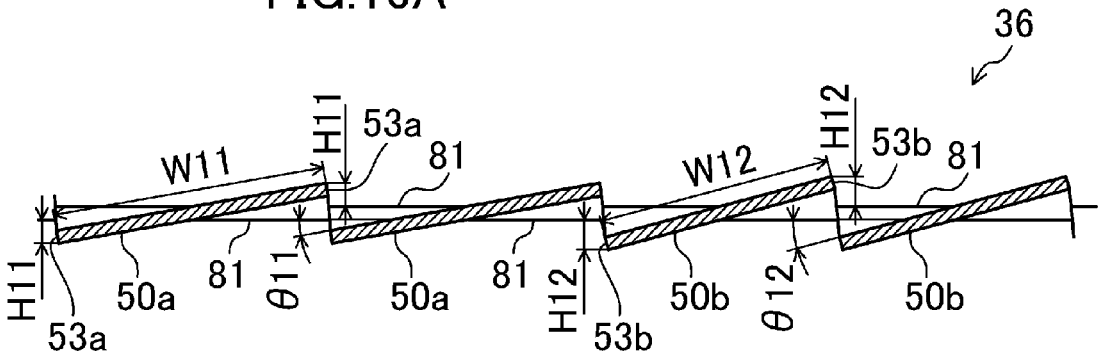
FIGS. 16A and 16B are enlarged views partially illustrating part of the heat exchanger illustrated in FIG. 15B.
Figure 16B:
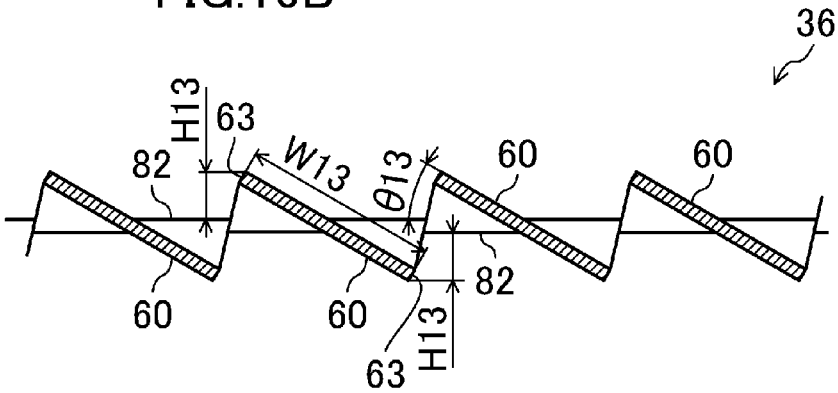

As illustrated in FIG. 16A, two windward louvers (50*a*) located at the windward side have a width W11 in the transverse direction (i.e., in the air passage direction), a tilt angle θ11 relative to the flat portions (81, 83), and a bent-out height (i.e., the distance from the bent-out ends (53*a*) to the flat portions (81, 83)) H11. Four windward louvers (50*b*) located at the leeward side have a width W12 in the transverse direction (in the air passage direction), a tilt angle θ12 relative to the flat portions (81, 83), and a bent-out height (i.e., the distance from the bent-out ends (53*b*) to the flat portions (81, 83)) H12. As illustrated in FIG. 16B, the leeward louvers (60) has a width W13 in the transverse direction (in the air passage direction), a tilt angle θ13 relative to the flat portions (82, 84), and a bent-out height (i.e., the distance from the bent-out ends (63) to the flat portions (82, 84)) H13.

As illustrated in FIGS. 16A and 16B, the width W11 of the windward louvers (50*a*) is larger than the width W12 of the windward louvers (50*b*), and the width W12 of the windward louvers (50*b*) is larger than the width W13 of the leeward louvers (60) (i.e., W11>W12>W13). The tilt angle θ11 of the windward louvers (50*a*) is smaller than the tilt angle θ12 of the windward louvers (50*b*), and the tilt angle θ12 of the windward louvers (50*b*) is smaller than the tilt angle θ13 of the leeward louvers (60) (i.e., θ11<θ12<θ13). That is, the windward louvers (50*a*) are tilted more gently than the windward louvers (50*b*), and the windward louvers (50*b*) are tilted more gently than the leeward louvers (60). The bent-out height H11 of the windward louvers (50*a*) is smaller than the bent-out height H12 of the windward louvers (50*b*), and the bent-out height H12 of the windward louvers (50*b*) is smaller than the bent-out height H13 of the leeward louvers (60) (i.e., H11<H12<H13).

In the heat exchanger (30), the heat transfer parts (37) of the fins (35) are arranged at the same pitch in the direction in which the flat tubes (33) extend. Specifically, as illustrated in FIG. 18, in the heat exchanger (30), the heat transfer parts (37) are spaced from one another by a distance D10 in the direction in which the flat tubes (33) extend. The distance D10 is equal to the height of the tabs (48). On the other hand, the bent-out heights of the windward louvers (50*a*, 50*b*) and the leeward louvers (60) have the relationship of H11<H12<H13. Thus, in the two heat transfer parts (37) adjacent to each other in the direction in which the flat tubes (33) extend, the distance D11 between the windward louvers (50*a*) at the windward side is larger than the distance D12 between the windward louvers (50*b*) at the leeward side, and the distance D12 between the windward louvers (50*b*) at the leeward side is larger than the distance D13 between the leeward louvers (60) (i.e., D10>D11>D12>D13).

As illustrated in FIGS. 17A and 17B, the bent-out ends (53, 63) of the windward louvers (50) and the leeward louvers (60) include main edges (54, 64), upper edges (55, 65), and lower edges (56, 66). The main edges (54, 64) extend substantially in parallel with the direction in which the front edges (38) of the heat transfer parts (37) extend. The upper edges (55, 65) extend from the upper ends of the main edges (54, 64) to the upper ends of the louvers (50, 60), and are tilted relative to the main edges (54, 64). The lower edges (56, 66) extend from the lower ends of the main edges (54, 64) to the lower ends of the louvers (50, 60), and are tilted relative to the main edges (54, 64).

As illustrated in FIG. 17A, in each of the windward louvers (50), the upper edge (55) is tilted at a tilt angle θ14 relative to the main edge (54), and the lower edge (56) is tilted at a tilt angle θ15 relative to the main edge (54). As illustrated in FIGS. 15A and 15B, in each of the windward louvers (50), the tilt angle θ15 of the lower edge (56) is smaller than the tilt angle θ14 of the upper edge (55) (i.e., θ15<θ14). Thus, in each of the windward louvers (50), the lower edge (56) is longer than the upper edge (55). Each of the windward louvers (50) is an asymmetric louver in which the shape of the bent-out end (53) is asymmetric in the vertical direction.

FIG. 17A illustrates the windward louvers (50*b*) located at the leeward side. As also illustrated in FIG. 16A, these windward louvers (50*b*) have the bent-out height H12.

As illustrated in FIG. 17B, in each of the leeward louvers (60), the upper edge (65) is tilted at a tilt angle θ16 relative to the main edge (64), and the lower edge (66) is tilted at a tilt angle θ17 relative to the main edge (64). As illustrated in FIGS. 15A and 15B, in the two leeward louvers (60*a*) located at the windward side, the tilt angle θ16 of the lower edge (66) is smaller than the tilt angle θ17 of the upper edge (65) (i.e., θ16<θ17). Thus, in each of the leeward louvers (60*a*), the lower edge (66) is longer than the upper edge (65). The leeward louvers (60*a*) are asymmetric louvers in each of which the shape of the bent-out end (63) is asymmetric in the vertical direction. On the other hand, in the sixth leeward louvers (60*b*) located at the leeward side, the tilt angle θ16 of the lower edge (66) is equal to the tilt angle θ17 of the upper edge (65) (i.e., θ16=θ17). Thus, in each of these leeward louvers (60*b*), the length of the lower edge (66) is equal to that of the upper edge (65). The leeward louvers (60*b*) are symmetric louvers in each of which the shape of the bent-out end (63) is symmetric in the vertical direction.

FIG. 17B illustrates the leeward louvers (60*b*) located at the leeward side. As also illustrated in FIG. 16B, the leeward louvers (60*b*) have the bent-out height H13.

Advantages of Second Embodiment

Advantages of the heat exchanger (30) of this embodiment are substantially the same as those of the heat exchanger (30) of the first embodiment.

Specifically, in the same manner as in the heat exchanger (30) of the first embodiment, in the heat exchanger (30) of the second embodiment, the lower ends of the windward louvers (50) are located above the lower ends of the leeward louvers (60), and in addition, the bent-out heights H11 and H12 of the windward louvers (50) are smaller than the bent-out height H13 of the leeward louvers (60). Accordingly, in heating operation of the air conditioner (10), frost can be attached not only to the windward louvers (50) but also to the leeward louvers (60), thereby prolonging time duration of the heating operation. In defrosting operation of the air conditioner (10), drain water generated near the windward louvers (50) can be quickly discharged downward, and a sufficient amount of heat can be transmitted from the heat transfer parts (37) to frost with the frost being kept in contact with the surfaces of the heat transfer parts (37). As a result, time necessary for the defrosting operation can be reduced. In addition, drain water dropped down below the windward louvers (50) can be moved to the leeward by capillary action, thereby reducing the amount of drain water remaining on the surfaces of the heat transfer parts (37) at the end of the defrosting operation. As a result, the time interval before next defrosting operation can be prolonged.

In the same manner as in the heat exchanger (30) of the first embodiment, in the heat exchanger (30) of the second embodiment, the tilt angles θ15 and θ17 of the lower edges (56, 66) of the bent-out ends (53, 63) are smaller than the tilt angles θ14 and θ16 of the upper edges (55, 65) of the bent-out ends (53, 63) in all the windward louvers (50) and some of the leeward louvers (60*a*). Accordingly, drain water in a gap between the windward louvers (50) or the leeward louvers (60*a*) that are adjacent to each other in the air passage direction can be discharged downward by utilizing both gravity and a capillary phenomenon.

Third Embodiment

A third embodiment of the present disclosure will be described. A heat exchanger (30) according to the third embodiment is obtained by changing the configuration of the fins (36) in the heat exchanger (30) of the second embodiment. Now, part of the configuration of fins (36) of the heat exchanger (30) of this embodiment different from those of the heat exchanger (30) of the second embodiment.

<Fin Configuration>

Figure 19:
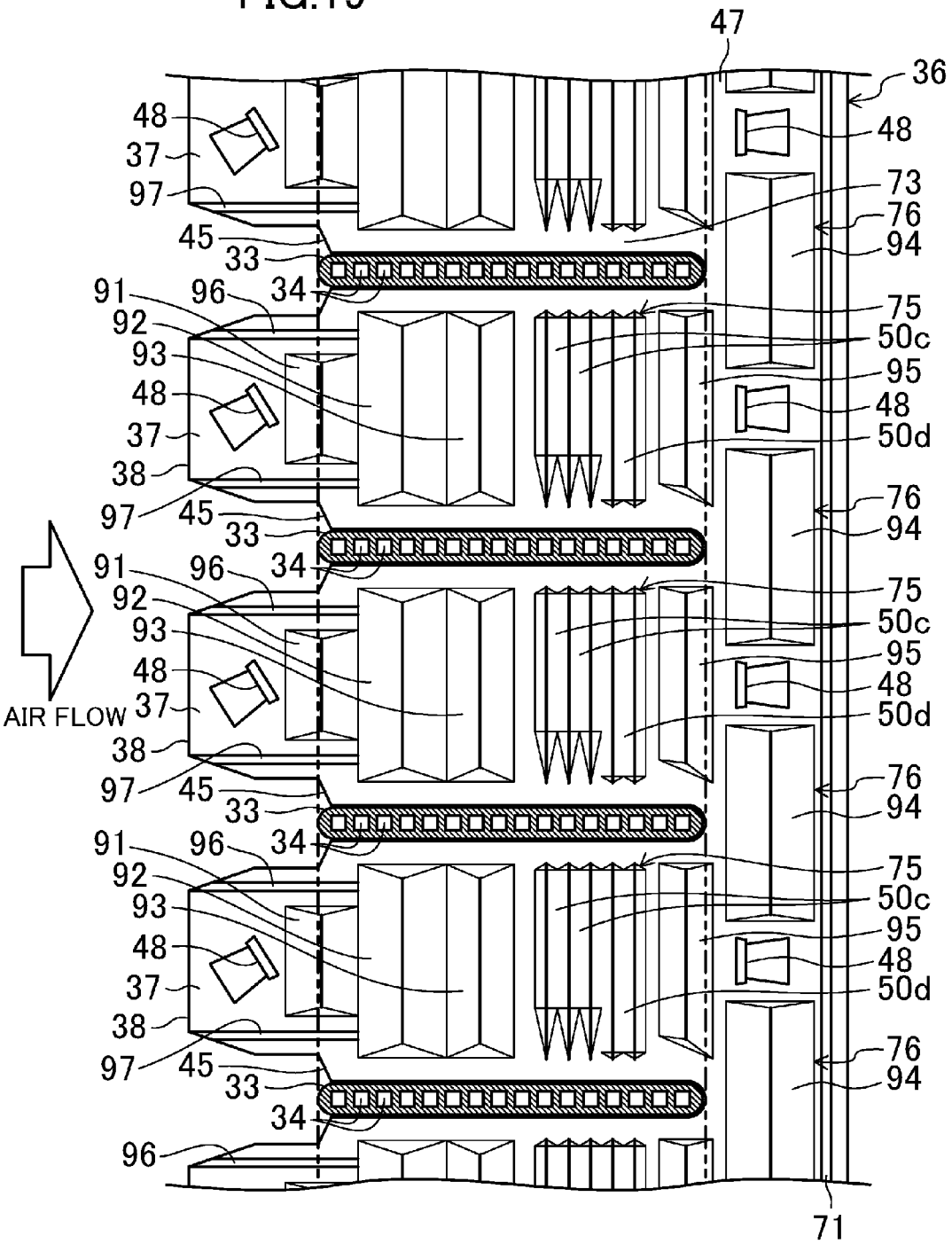
FIG. 19 is a cross-sectional view illustrating a heat exchanger according to a third embodiment and corresponds to FIG. 14.
Figure 20A:
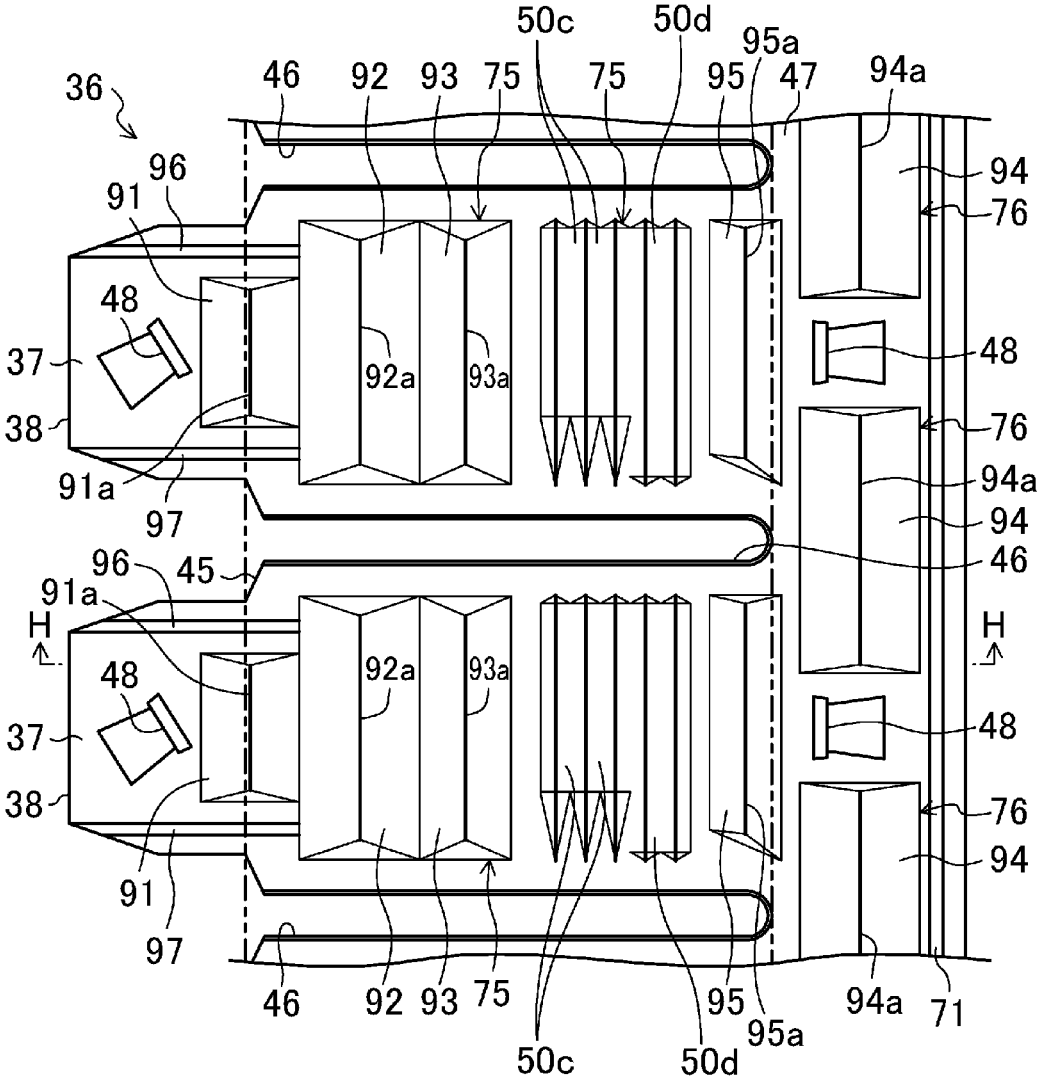
FIGS. 20A and 20B illustrate a main portion of a fin of the heat exchanger of the third embodiment.
Figure 20B:
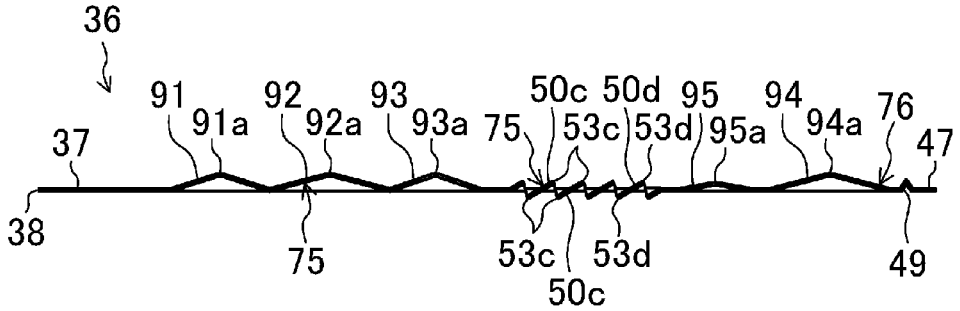

As illustrated in FIGS. 19, 20A, and 20B, each of the fins (36) of this embodiment includes windward heat-transmission promotion sections (75), leeward heat-transmission promotion sections (76), and auxiliary protruding sections (95), instead of the windward louvers (50) and the leeward louvers (60) of the first embodiment. The windward heat-transmission promotion sections (75) are provided in each heat transfer part (37). The leeward heat-transmission promotion sections (76) are provided in a leeward plate portion (47). Each of the auxiliary protruding sections (95) is provided in a region extending from an associated one of the heat transfer parts (37) to the leeward plate portion (47). The windward heat-transmission promotion sections (75), the leeward heat-transmission promotion sections (76), and the auxiliary protruding sections (95) will be described later.

<Heat Transfer Part of Fin>

The windward heat-transmission promotion sections (75) provided in each of the heat transfer parts (37) of the fins (36) include a plurality of louvers (50*c*, 50*d*) and a plurality of protrusions (91-93). In each of the heat transfer parts (37), the protrusions (91-93) are located at the windward side of the louvers (50*c*, 50*d*). The numbers of the protrusions (91-93) and the louvers (50*c*, 50*d*) described below are merely examples.

Specifically, three protrusions (91-93) are provided in a windward region of each of the heat transfer parts (37) of the fins (36). The three protrusions (91-93) are arranged side by side in the air passage direction. That is, in the heat transfer part (37), a first protrusion (91), a second protrusion (92), and a third protrusion (93) are arranged in this order from the windward to the leeward.

The protrusions (91-93) have inverted V shapes formed by making the heat transfer part (37) protrude toward air passages (39). Each of the protrusions (91-93) extends in a direction intersecting with the air passage direction in the air passages (39). Each of the three protrusions (91-93) protrudes to the right when viewed from front edges (38) of the fins (36). Ridges (91*a*, 92*a*, 93*a*) of the respective protrusions (91-93) are substantially in parallel with the front edges (38) of the fins (36). That is, the ridges (91*a*, 92*a*, 93*a*) of the protrusions (91-93) intersect with the airflow direction in the air passages (39).

The louvers (50*c*, 50*d*) are obtained by forming slits in the heat transfer part (37) and plastically deforming portions between adjacent ones of the slits. The longitudinal direction of the louvers (50*c*, 50*d*) is substantially in parallel with (i.e., substantially in the vertical direction) the front edge (38) of the fin (36). That is, the longitudinal direction of the louvers (50*c*, 50*d*) intersects with the air passage direction. The louvers (50*c*, 50*d*) have the same length.

As illustrated in FIG. 20B, the louvers (50*c*, 50*d*) are tilted relative to their peripheral flat portions. Specifically, bent-out ends (53*c*, 53*d*) at the windward sides of the louvers (50*c*, 50*d*) protrude to the left when viewed from the front edge (38) of the fins (36). On the other hand, bent-out ends (53*c*, 53*d*) at the leeward sides of the louvers (50*c*, 50*d*) protrude to the right when viewed from the front edge (38) of the fin (36).

The louvers (50*c*) located in a windward region are asymmetric louvers similar to the windward louvers (50) and the leeward louvers (60*a*) in a windward region of the first embodiment. That is, in the louvers (50*c*), the shapes of the bent-out ends (53*c*) are asymmetric in the vertical direction. On the other hand, the louvers (50*d*) located in a leeward region are symmetric louvers similar to the leeward louvers (60*b*) located in a leeward region of the first embodiment. That is, in each of the louvers (50*d*), the shape of the bent-out end (53*d*) is symmetric in the vertical direction.

As illustrated in FIG. 20A, in each of the heat transfer parts (37) of the fin (36), a tab (48) is provided to be located windward of the first protrusion (91). The tab (48) is located near the middle, in the vertical direction, of the heat transfer part (37). In addition, the tab (48) is tilted relative to the front edge (38) of the fin (36).

Each of the heat transfer parts (37) of the fin (36) includes an upper horizontal rib (96) and a lower horizontal rib (97). The upper horizontal rib (96) is located above the first protrusion (91), and the lower horizontal rib (97) is located below the first protrusion (91). The horizontal ribs (96, 97) have straight slender ridge shapes extending from the front edge (38) of the fin (36) to the second protrusion (92). In the same manner as the protrusion (91-94), the horizontal ribs (96, 97) are formed by making the heat transfer part (37) protrude toward air passages (39). The horizontal ribs (96, 97) protrude in the same direction as the direction in which the protrusion (91-94) protrude.

<Leeward Plate Portion of Fin>

The leeward heat-transmission promotion sections (76) provided in the leeward plate portion (47) of the fin (36)

include leeward protrusions (94). In the leeward plate portions (47), the leeward protrusions (94) and the tabs (48) are alternately arranged in the vertical direction. Specifically, in the leeward plate portions (47), one leeward protrusion (94) is located at the leeward side of each notch (45), and one tab (48) is located between vertically adjacent ones of the leeward protrusions (94).

The leeward protrusions (94) have inverted V shapes formed by making the leeward plate portions (47) protrude. Each of the leeward protrusions (94) extends in a direction intersecting with the air passage direction in the air passages (39). Each of the leeward protrusions (94) protrudes to the right when viewed from the front edges (38) of the fin (36). Ridges (94*a*) of the leeward protrusions (94) are substantially in parallel with the front edges (38) of the fin (36). That is, the ridges (94*a*) of the leeward protrusions (94) intersect with the airflow direction in the air passages (39). When viewed from the front edges (38) of the fin (36), each of the leeward protrusions (94) overlaps with the protrusions (91-93) and the louvers (50*c*, 50*d*) constituting the windward heat-transmission promotion section (75) of two heat transfer parts (37) sandwiching the notch (45) adjacent to this leeward protrusion (94).

<Auxiliary Protruding Section of Fin>

As described above, in each of the fins (36), one auxiliary protruding section (95) is provided in a region extending from an associated one of the heat transfer parts (37) to the leeward plate portion (47).

The auxiliary protruding sections (95) have inverted V shapes formed by making the fin (36) protrude. Each of the auxiliary protruding section (95) extends in a direction intersecting with the air passage direction in the air passages (39). Each of the auxiliary protruding sections (95) protrudes to the right when viewed from the front edges (38) of the fin (36). Ridges (95*a*) of the auxiliary protruding sections (95) are substantially in parallel with the front edges (38) of the fin (36). That is, the ridges (95*a*) of the auxiliary protruding sections (95) intersect with the airflow direction in the air passages (39). The lower ends of the auxiliary protruding sections (95) is tilted downward toward the leeward.

Advantages of Third Embodiment

In the heat exchanger (30) of this embodiment, the louvers (50*c*, 50*d*) are provided in each of the heat transfer parts (37) of the fins (36), and some of the louvers (50*c*) located at the windward side are asymmetric louvers. Thus, drain water between ones of the louvers (50*c*) that are adjacent to each other in the air passage direction can be discharged downward by utilizing both gravity and a capillary phenomenon.

Other Embodiments

Variations of the heat exchangers (30) of the first and second embodiments will be described.

—First Variation—

In the heat exchangers (30) of the first and second embodiments, the longitudinal directions of the louvers (50, 60, 70) provided in the heat transfer parts (37) of the fins (35, 36) may be tilted relative to the vertical direction.

Figure 21:
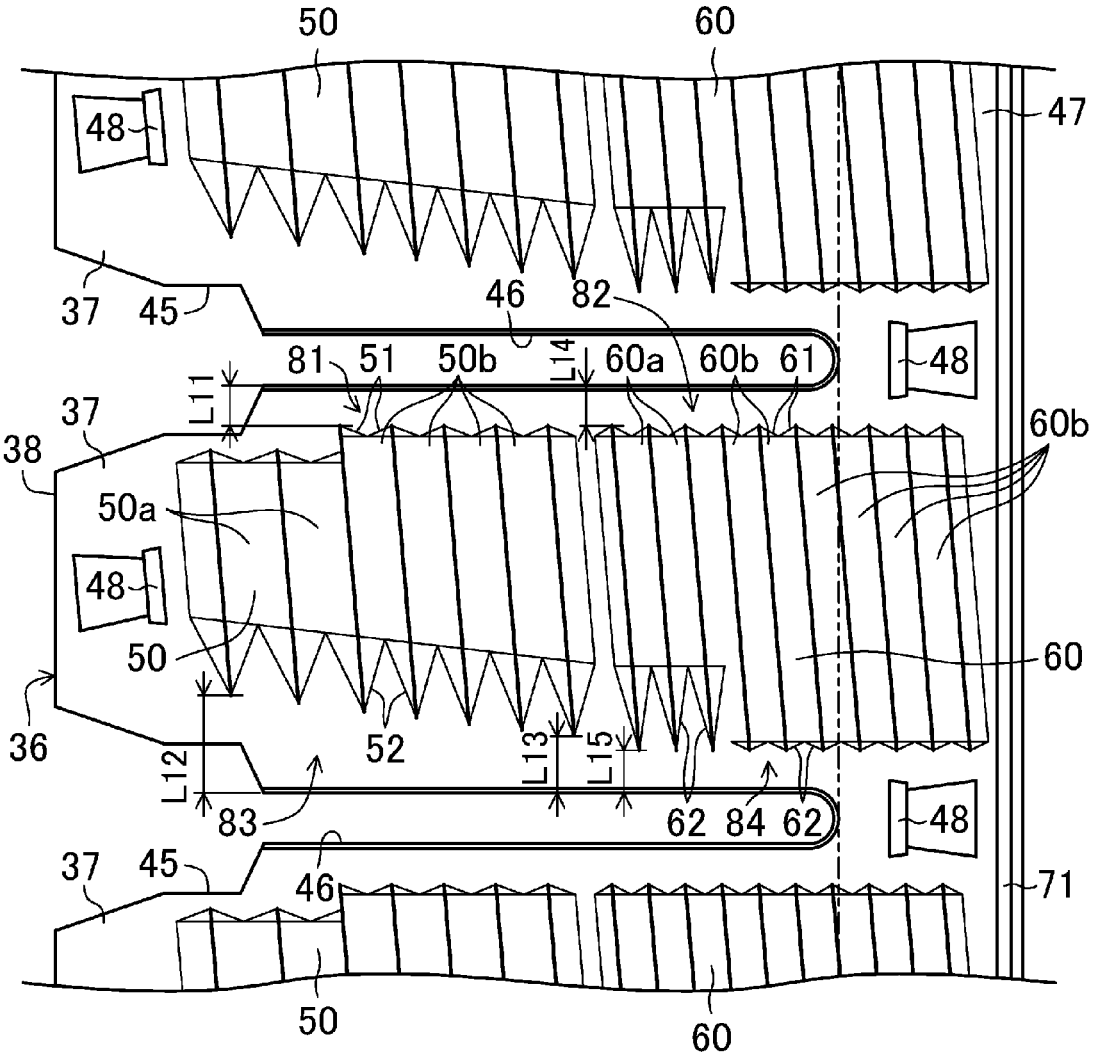
FIG. 21 is a front view illustrating a fin obtained by applying a first variation as other embodiments to the fin of the second embodiment, and corresponds to FIG. 15A.

FIG. 21 illustrates an application of this variation to the fins (36) of the heat exchanger (30) of the second embodiment. In the heat transfer part (37) of the fin (36) illustrated in FIG. 21, the longitudinal directions of all the louvers (50, 60) are tilted about 5° relative to the front edge (38) of the heat transfer part (37) (i.e., relative to substantially the vertical direction). The louvers (50, 60) are tilted such that the lower ends thereof are located leeward of the upper ends thereof. As long as the tilt angle of the louvers (50, 60) relative to the vertical direction is approximately within 20°, the longitudinal direction of the louvers (50, 60) can be regarded as substantially the vertical direction.

In a case where the louvers (50, 60) are tilted as illustrated in FIG. 21, drain water generated in defrosting operation of the air conditioner (10) is guided to the leeward while flowing along the louvers (50, 60). Thus, this variation further ensures that drain water generated in defrosting operation flows to the leeward, thereby reducing the amount of drain water remaining on the surfaces of the heat transfer parts (37) at the end of the defrosting operation.

—Second Variation—

Figure 22A:
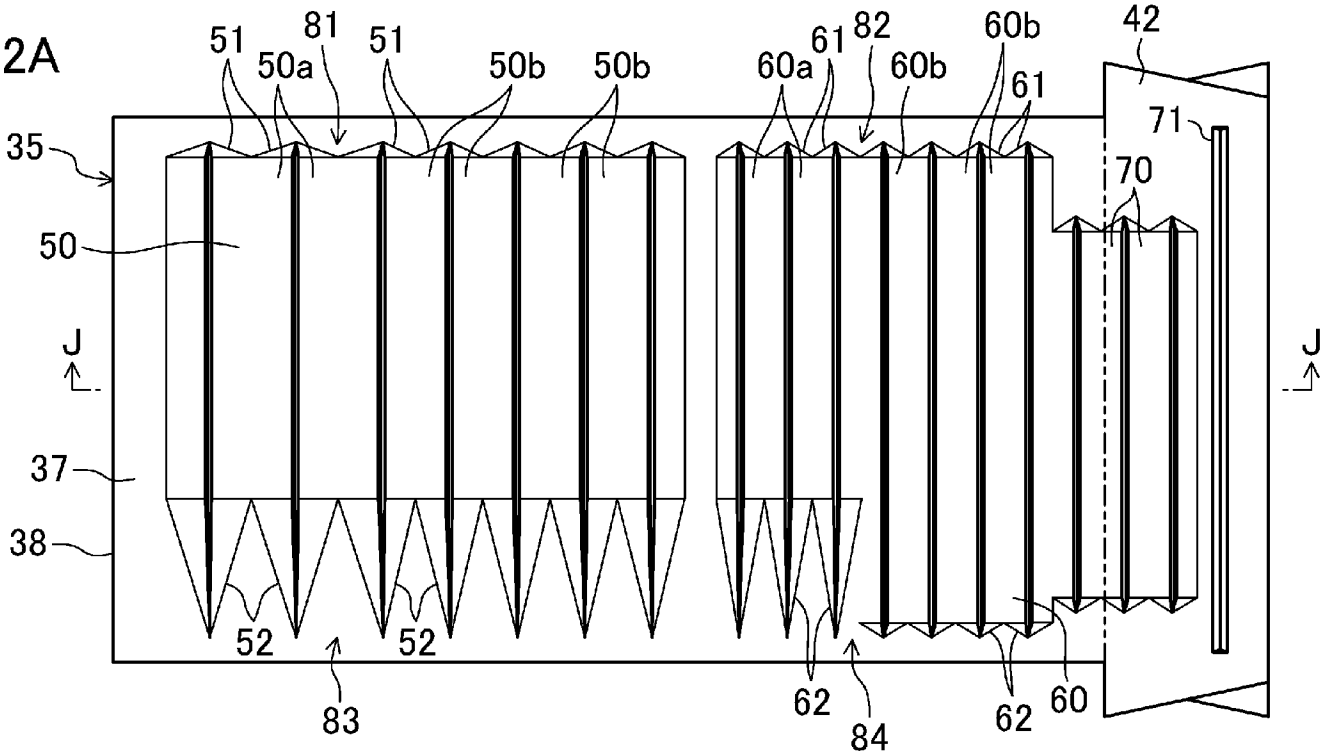
FIGS. 22A and 22B are views illustrating heat transfer parts obtained by applying a second variation as other embodiments to the fin of the first embodiment.
Figure 22B:
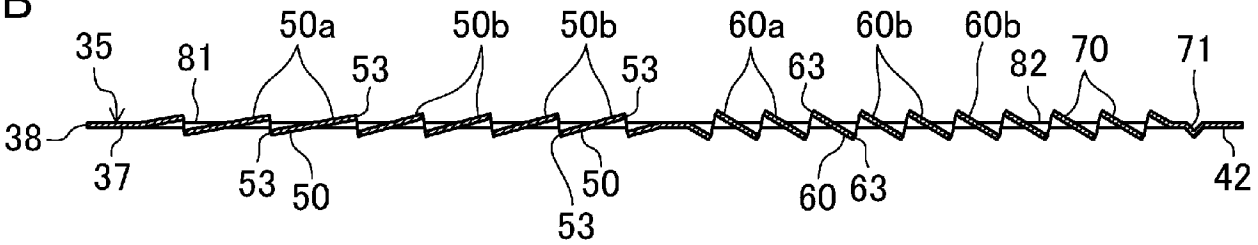

In the heat exchangers (30) of the first and second embodiments and the first variation, the windward louvers (50) and the leeward louvers (60) provided in the heat transfer parts (37) of the fins (35, 36) may have the same vertical length. FIGS. 22A and 22B illustrate an application of this variation to the fins (35) of the heat exchanger (30) of the first embodiment. In the heat transfer parts (37) of the fins (35) illustrated in FIGS. 22A and 22B, all the windward louvers (50) and all the leeward louvers (60) in the heat transfer parts (37) have the same vertical length.

—Third Variation—

Figure 23A:
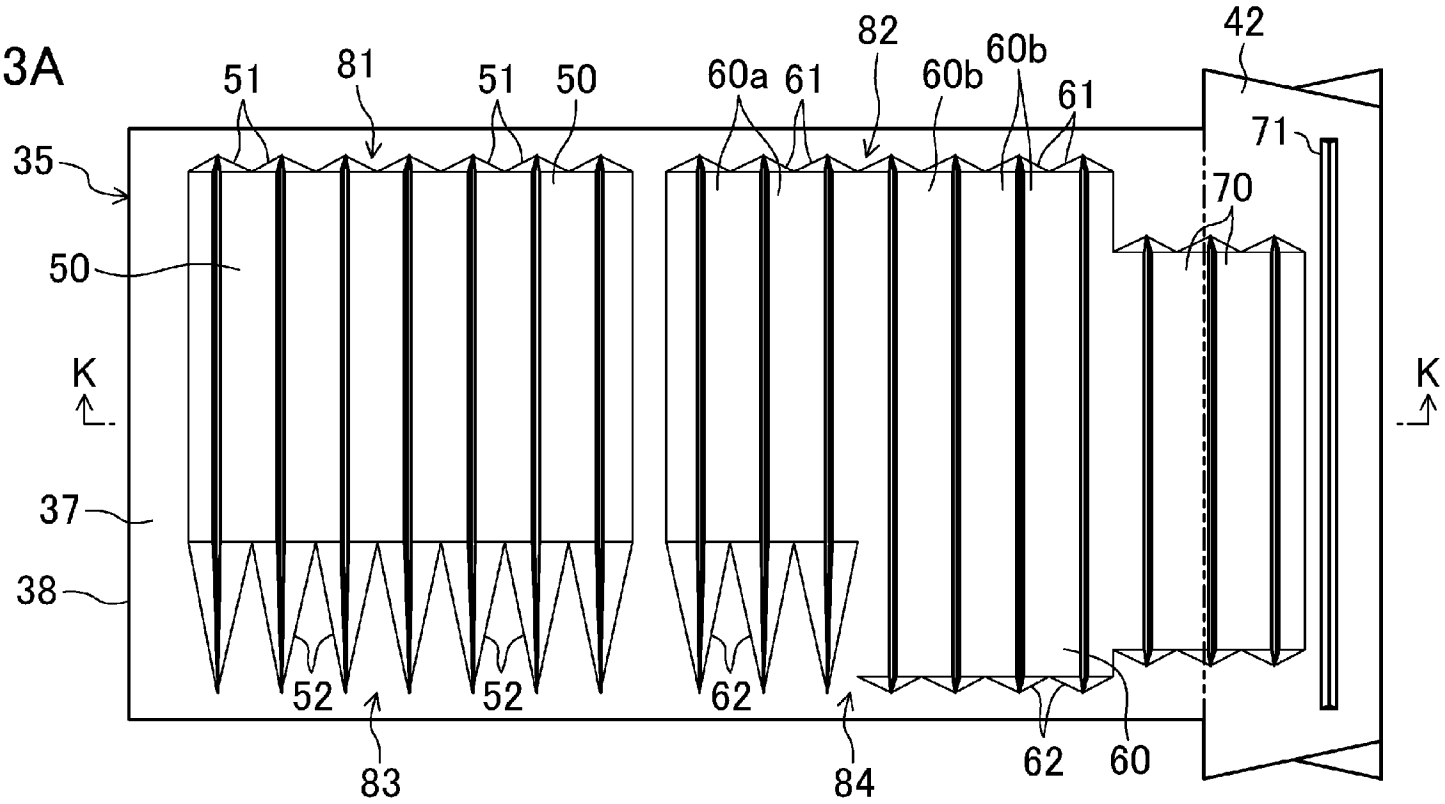
FIGS. 23A and 23B are views illustrating heat transfer parts obtained by applying a third variation as other embodiments to the fin of the second embodiment.
Figure 23B:
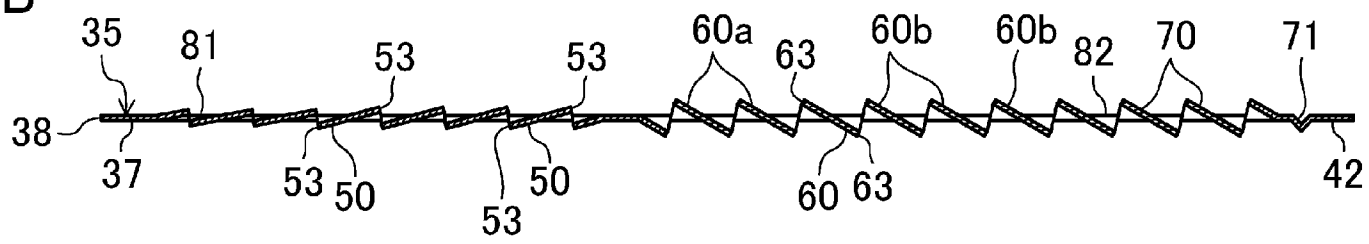

In the heat exchangers (30) of the first and second embodiments and the first and second variations, the windward louvers (50) and the leeward louvers (60) provided in the heat transfer parts (37) of the fins (35, 36) may have the same the widths in the transverse direction. FIGS. 23 and 23B illustrate an application of this variation to the fins (35) of the heat exchanger (30) of the second variation. In the heat transfer parts (37) of the fins (35) illustrated in FIGS. 23 and 23B, all the windward louvers (50) and all the leeward louvers (60) have the same width in the transverse direction (i.e., in the air passage direction).

—Fourth Variation—

Figure 24:
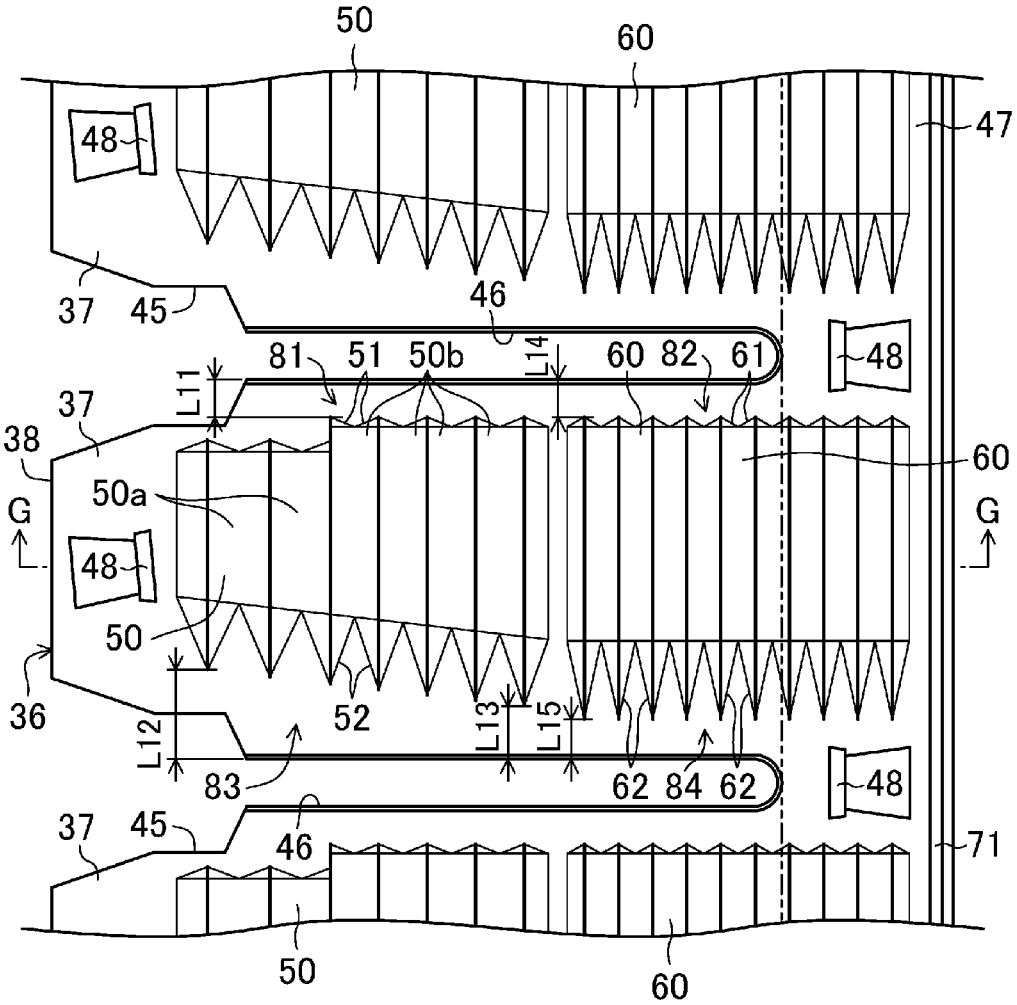
FIG. 24 is a front view illustrating a main portion of a fin obtained by applying a fourth variation as other embodiments to the second embodiment.

In the heat exchangers (30) of the first and second embodiments and the first, second, and third variations, all the windward louvers (50) and the leeward louvers (60) provided in the heat transfer parts (37) of the fins (35, 36) may be asymmetric louvers. FIG. 24 illustrates an application of this variation to the fins (35) of the heat exchanger (30) of the second embodiment. In all the windward louvers (50) and all the leeward louvers (60) of the heat transfer parts (37) of the fins (35) illustrated in FIG. 24, the shape of each of the bent-out ends (53, 63) is asymmetric in the vertical direction.

The foregoing embodiments are merely preferred examples in nature, and are not intended to limit the scope, applications, and use of the invention.

INDUSTRIAL APPLICABILITY

As described above, the present disclosure is useful for a heat exchanger including vertically arranged flat tubes and fins.

DESCRIPTION OF REFERENCE CHARACTERS

10 air conditioner
20 refrigerant circuit
30 heat exchanger
33 flat tube
34 fluid passage (passage)
35 fin
36 fin
37 heat transfer part

39 air passage
41 intermediate plate part
45 notch
50 windward louver (asymmetric louver)
53 bent-out end
54 main edge
55 upper edge
56 lower edge
60 leeward louver
60*a* leeward louver (asymmetric louver)
60*b* leeward louver (symmetric louver)
63 bent-out end
64 main edge
65 upper edge
66 lower edge

The invention claimed is:

1. A heat exchanger, comprising:

flat tubes vertically arranged with side surfaces thereof facing one another, each of the flat tubes including a fluid passage therein; and fins each dividing a space between adjacent ones of the flat tubes into a plurality of air passages through which air flows, wherein each of the fins includes heat transfer parts each having a plate shape extending from an adjacent one of the flat tubes to another adjacent one of the flat tubes, the heat transfer parts forming side walls of the air passages, in the fins, louvers that extend in an up-and-down direction and bend out from the heat transfer parts are arranged in an air passage direction, a bent-out end of each of the louvers includes a main edge, an upper edge extending from an upper end of the main edge to an upper end of the louver and tilted relative to the main edge, and a lower edge extending from a lower end of the main edge to a lower end of the louver and tilted relative to the main edge, at least one of the louvers provided on each of the heat transfer parts of the fins is a symmetric louver which is located in a leeward region of the louvers and in which a tilt angle of the lower edge relative to the main edge is equal to a tilt angle of the upper edge relative to the man edge, the or each of the other louvers located at a windward side of the symmetric louver is an asymmetric louver in which a tilt angle of the lower edge relative to the main edge is smaller than a tilt angle of the upper edge to the main edge, and in each of the heat transfer parts of the fins, the or each asymmetric louver is arranged only windward of the symmetric louver or louvers.

2. The heat exchanger of claim 1, wherein the fins each have a plate shape with notches into which the flat tubes are inserted, are arranged to be spaced from one another by a predetermined distance in a direction in which the flat tubes extend, and sandwich the flat tubes at edges of the notches, and parts of the fins between vertically adjacent ones of the notches are the heat transfer parts.

3. The heat exchanger of claim 1, wherein each of the fins is a corrugated fin that bends up and down and is located between adjacent ones of the flat tubes, includes the heat transfer parts arranged in a direction in which the flat tubes extend, and also includes intermediate plate parts continuous to upper or lower ends of adjacent ones of the heat transfer parts and joined to the flat tubes.

4. An air conditioner, comprising:

a refrigerant circuit including the heat exchanger of claim 1, wherein the refrigerant circuit circulates refrigerant therein, thereby performing a refrigeration cycle.

* * * * *